United States Patent [19]

Deola

[11] Patent Number: 4,784,384

[45] Date of Patent: Nov. 15, 1988

[54] WEIGHTLIFTING EXERCISE DEVICE

[76] Inventor: James A. Deola, 5116 E. Chestnut Ave., Vineland, N.J. 08360

[21] Appl. No.: 53,392

[22] Filed: May 22, 1987

Related U.S. Application Data

[63] Continuation-in-part of Ser. No. 816,744, Jan. 6, 1986, abandoned.

[51] Int. Cl.[4] ..... A63B 21/06

[52] U.S. Cl. ..... 272/118; 272/134; 272/DIG. 4

[58] Field of Search ..... 272/93, 117, 118, 123, 272/134, 136, 142, 143, 144, DIG. 4

[56] References Cited

U.S. PATENT DOCUMENTS

| | | | |
|---|---|---|---|
| Re. 28,066 | 7/1974 | Marcyan . | |
| 345,286 | 7/1886 | Dowd . | |
| 374,496 | 12/1887 | Reach . | |
| 434,439 | 8/1890 | Forest . | |
| 457,400 | 8/1891 | Dowd . | |
| 676,771 | 6/1901 | Reach . | |
| 2,472,391 | 6/1949 | Albizu . | |
| 3,072,400 | 1/1963 | Dykinga . | |
| 3,115,339 | 12/1963 | Forte . | |
| 3,235,255 | 2/1966 | Leflar | 272/123 |
| 3,346,256 | 10/1967 | White | 272/81 |
| 3,361,215 | 1/1975 | Bradley | 272/134 X |
| 3,524,644 | 8/1970 | Kane | 272/134 |
| 3,850,431 | 11/1974 | Winans | 272/81 |
| 4,072,309 | 2/1978 | Wilson | 272/136 |
| 4,109,907 | 8/1978 | Zito | 272/117 |
| 4,239,210 | 12/1980 | Lambert, Jr. | 272/118 |
| 4,257,590 | 3/1981 | Sullivan et al. | 272/117 |
| 4,306,715 | 12/1981 | Sutherland | 272/117 |
| 4,316,609 | 2/1982 | Silbermann | 272/118 |
| 4,402,504 | 9/1983 | Christian | 272/118 |
| 4,441,706 | 4/1984 | Korzaniewski | 272/118 |
| 4,564,193 | 1/1986 | Stewart | 272/118 |
| 4,564,194 | 1/1986 | Dawson | 272/123 |
| 4,598,908 | 8/1986 | Morgan | 272/134 |
| 4,600,189 | 7/1986 | Olschansky et al. | 272/118 |
| 4,624,457 | 11/1986 | Silberman et al. | 272/118 |
| 4,634,127 | 1/1987 | Rockwell | 272/134 |

FOREIGN PATENT DOCUMENTS

| | | | |
|---|---|---|---|
| 2514263 | 4/1983 | France | 272/134 |
| 2158362 | 11/1985 | United Kingdom | 272/134 |
| 8202667 | 8/1982 | World Int. Prop. O. | 272/118 |

*Primary Examiner*—Richard J. Apley
*Assistant Examiner*—Robert D. Bahr
*Attorney, Agent, or Firm*—Thomas A. Lennox

[57] ABSTRACT

An exercise machine that allows essentially unlimited number of lifting exercises to be performed that operates like free weights but with the safety of a universal gym including a single stack of weights connected through a pulley system extending vertically upwardly to a frame and then downwardly along vertical frame members from point locations to connect to two separate connection points on an exercise grasping device all in a single plane wherein movement of either connecting point, lift the weight and an adjustable weight supply device comprising a vertical rod and tube centrally positioned in a vertical hole through the weight stack to allow both the choice of number of weights as well as the height at which the weight is first lifted.

36 Claims, 15 Drawing Sheets

2
56
52
54
64
60
128
68
176
124
20
26
107
32
114
120
30
50
38
46
112
42
44
114
122
126
24
108
40
123
119
104
144
121
22
70
28
74
140
114
76
110
34
80
116
2
78
108
72
82
106
130
142
134
132
141
34
90
92
88
138
94
36
86
98
136
139
84
34
96
100
102

WEIGHTLIFTING EXERCISE DEVICE

This application is a continuation-in-part of Ser. No. 816,744, filed Jan. 6, 1986, now abandoned.

BACKGROUND OF THE INVENTION

This invention involves an exercise device to allow a large variety of weight lifting exercises to be performed, including all of the various exercises utilized by a serious weightlifter or body builder. In particular, this invention involves the characteristics and "feel" of free weight lifting exercise essential in the sport of body building, without the inherent loose weight handling problems and massive equipment requirements.

The serious weightlifter and body builder employs the use of free weights; that is dumbells and barbells that are not connected to any device. As the weight is increased for the weightlifter, technique becomes all important. Balance of the weight being lifted close to the uppermost limit of the lifter, is a critical technique. As the weight is increased, the weightlifter must, of necessity, act to balance the weight during the lift and during the required holding time. The muscles and technique required to balance these weights close to the lifter's tolerance level is critical to his performance. Similarly, a body builder wants to develop every muscle, and the muscles required to balance the weight during the lifting exercises are very important and can not be neglected in his regimen.

Lifting with free weights however requires much handling of different quantities of weights and dumbells. This is very tiring and time consuming and decreases the efficiency of performing several different exercises in a short period of time. Also in order to be able to perform the complete variety of exercises required by a serious body builder, massive amounts of dumbells, barbells, and auxiliary lifting equipment such as weight racks and benches are required. This therefore requires that the person join a gym in order to exercise or purchase an inferior all in one type exercise device for use at home.

A number of weight training devices have been described and offered in the market place generally described as "universal" gyms. These machines include several stacks of steel plates with any chosen number being connected to steel cables. The cables are guided by pulleys to various locations of the apparatus. In these devices, the connection is either to multiple stacks of weights connected to the same grasping exercise element or by a single cable to a single set of weights. These devices offer the advantage of relative safety in that when operated alone, the person has little risk of being caught under the weights since movement of the weight stack is channeled and restricted to a single planar movement away from the person exercising. The grasping element utilized to lift the weight stack is also channeled in a single plane of motion on a variety of exercises. This channeled movement against a resistance is not useful in improving the technique of weightlifting and since the device eliminates the need to balance the grasping device, muscles and the technique of holding the weight in a plane are neglected. Similar type exercising devices utilizing one stack of weights to perform various types of exercises are also available. These devices however are limited in the type exercises which can be performed and do not eliminate the problem of channeled single planar movement on certain essential exercises such as the bench press and leg squat. In addition, the effort required to alter these machines to perform different exercises is not practical for a serious body builder who needs to perform 10 to 20 different exercises in each workout and as many as 50 through the course of his entire weekly routine. Thus, all of these devices are useful weightlifting devices but fall short of ultimate weight training and the development of technique that is offered with free weightlifting. Thus, although these devices offer improvements, the serious weightlifter or body builder must ultimately return to free lift exercises.

A number of exercise devices have been described in the prior art, but none of these devices offer the advantages of the present invention nor attain the objects set forth hereinbelow.

SUMMARY OF THE INVENTION

My invention is an exercise device which allows essentially every exercise to be performed in a safe manner but with the characteristics of free weightlifting. The exercise device includes a single resisting force device to allow an adjustable amount of force resistance to be lifted from a single point attachment. In the broader configurations of the present invention, where the single resisting force device is not described in the preferred embodiments, this device includes not only a stack of weights as preferred but also includes elastomeric bands, spring members, hydraulic cylinders and any other device that allows an adjustable amount of force resistance to be lifted from a single point attachment. An exercise grasping device, allows the person to grasp an element at at least one grasping point, and for many exercises at two grasping points, and move the element against a weight resistance supplied by the single resisting force device. The grasping device includes a single grasping element, such as a bar, with the requirement that there be two separated connection points on the single grasping element. A cable device including two separate cables connecting the two separated connecting points to the single resisting force device is provided wherein the movement of either connection point lifts against the single resisting force device. A cable directioning device trains the cable means to training point locations on both sides of the person doing the exercises, enabling the person to pull against the resisting force device simultaneously from both sides of his or her body. The training point locations and the grasping point, or two grasping points, are in a single plane. The lifting or pulling point of the person and the cable directioning device including two training point locations are preferably all in the single plane. The preferred cable directioning device trains the cable device to point locations above the person and to point locations proximate to the height of the feet of the person. A frame device is provided to support the cable distributing device and the cable device so that the cables are trained above to the single resisting force device and to resist without distortion applied forces from the person moving the grasping means against the single resisting force device. A preferred weight distributing device is structurally attached to the frame device to receive and distribute force from a preferred support platform to the frame device to prevent lifting of the frame. The support platform is preferably located between vertical members of the frame device to hold the person doing the exercises and any auxiliary equipment used in the exercises and to direct forces downwardly from the person or the auxiliary equipment to the weight distribution means.

A preferred device includes a frame including two vertical frame members, each having an upper end and a lower end, a lower support member structurally and rigidly connecting the vertical frame members proximate to the lower end, and an upper support member structurally and rigidly connecting the vertical frame members proximate to the upper ends. A preferred support platform to support the person and any auxiliary equipment used in the exercise and to transmit forces downwardly from the platform. A preferred weight distribution device to distribute countervailing downward force from any exercise being conducted by a person from the support platform to the lower support member is provided. A single weight means to allow an adjustable amount of weight to be lifted to a single point location is preferably located outside one of the vertical frame members away from the platform. The preferred weight device includes a stack of separate weight members with a cable attachment device to connect it to the end of the cable. A preferred height adjustment device is provided to allow the height of the cable attachment device to be chosen above which any raising of the cable attachment device lifts weight members. The preferred weight device also includes a weight attachment device to allow any chosen number of weight members to be lifted by attachment to the cable attachment device. The preferred cable device includes two separate cables connecting the two training points to a single point location on the weight device wherein movement of either connection point a distance requires the same amount of force.

A preferred adjustable weight supply device includes a stack of separate weight members with a guide device to allow any or all of the members to be freely lifted upwardly but be restrained from sidewise movement. Holes in each weight member are vertically aligned to form a single vertical hole through the stack of members. A top member rests on top of the stack of weight members with a cylindrical tubular member structurally and rigidly attached to slideably interfit downwardly into the vertical hole through the balance of the weight members. A vertical rod member is structurally attached through a top attachment device to the cable end and extends downwardly and slideably interfitting vertically into the cylindrical tubular member. The top plate member can be extended to encompass the weight stack sidewise movement guide device maintaining alignment of the cylindrical tubular member and rod member. A second preferred method of maintaining this alignment is that the cylindrical tubular member have its interior shape matching the rod member such shape being but not limited to a square, hexagon, octagon, and the like. A plurality of horizontal holes are spaced along the length of the vertical rod and a plurality horizontal holes are spaced along the length of the cylindrical member. Horizontal holes through the weight members are provided wherein chosen holes in the rod, cylindrical member, and the weight members are capable of alignment. Finally, pin members are provided to interfit into the horizontal holes to interconnect the rod to the top member and a chosen number of weights to the cylinder. An upper pin member connects the rod to the top member, thereby adjusting the height at which any weights are to be lifted. A lower pin member is extended through the lowest weight member to be lifted into a horizontal hole in the cylindrical tube. More preferably, the lower pin member extends through the weight, cylindrical tube and rod member for added support.

It is an object of this invention to provide an exercise device that provides the effect of free weightlifting, but with adjustable limits on the height at which the weight can drop against the person.

It is an additional object of the present invention to provide a complete apparatus capable of allowing performance of fifty to one hundred exercises that a person in the sport of body building needs in order to develop every part of the body.

It is a further object of this invention to provide an apparatus allowing the person to perform all of the various exercises from one centralized location.

It is a further object of the present invention to provide a device wherein the unbalance of free weights is eliminated from side to side, but the necessity of balance of the lift in a horizontal plane is required.

It is a further object of the present invention to provide a device which allows exercise movements vertically guided eliminating the requirement for balance horizontally in any direction.

It is an additional object of the present invention to provide a device that will accommodate essentially all additional component devices necessary to carry out the various exercises including a horizontal bench which may be pivoted out of the way for standing exercises, as well as floor exercises.

It is a further object of this invention to provide a weight supply system which allows not only the choice of the amount of weight to be lifted but also the height at which the weight starts to be lifted from the stack, thus allowing the lift to be started from essentially any position and to adjust for the various sizes of the user and to provide a safety factor to adjust the height to which the barbell can fall.

It is an additional object of this invention to provide in a single weight source device a solution to the problem of uneven forces caused by lifting two separate grasping points in a vertical direction offset from the direction the weights are lifted with a counter balancing device such that the counter force of the lift is transmitted to offset the tendency to lift one side of the device.

It is a further object of this invention to provide multiple positions of support carriages to hold the barbell at any chosen height before or after the exercise.

It is a further object of the device to provide the capability of the barbell to rest freely upon the support carriages for positioning only, and also if desired to be secured to the support carriages such that movement of the barbell is restricted to the vertical plane along with the support carriages.

It is an additional object to provide a universal gym the will allow connection and interconnection of the various elements of the device to switch from one exercise to an Other with little alteration, delay or inconvenience.

It is an additional object of this invention to provide in one compact machine and few, by comparison pieces of equipment to allow the person to do the extremely large number of exercises required in weightlifting and body building.

A particular object of this invention to allow a person to do serious essentially unlimited weight training in the home alone without the need to have a helper in case of accident or an incomplete lift, enabling the person to lift heavy weight up to his or her ultimate limit of exhaustion.

A particular object of this invention is to provide safety if the person can not complete a lift, thus allowing the person to train to failure and get a much more intense workout without the danger of an incomplete lift causing an accident.

It is a further object of this invention to provide a machine that can be shipped in boxes and easily assembled for use.

It is an additional object of this invention to provide a weight stack device which eliminates weight handling and weight changes from exercise to exercise or from person to person.

It is a further object of this invention to provide an apparatus that can be adjusted as to the height and width to fit within a building or adjust to the size of the individual.

It is a further object of this invention to provide a device which allows an area of unobstructed floor space where multiple exercises can be conducted.

It is an additional object of the present invention to provide a device wherein the advantages of lifting a single unitary weight is accomplished by connecting the weight to two separate cables, evenly distributing the weight to both sides of the person exercising, provided equal stress to both sides in a variety of exercises to failure without yielding safety.

It is a particular object of this invention to provide an adjustable selector device allowing the length of the cables and thus the position of the bar or other exercise devices to be easily adjusted as to starting position.

It is an additional object of the present invention to provide a stress distribution device wherein the countervailing forces directed downwardly as a result of any exercise may be distributed from the person or any auxiliary device used in the exercise to stabilize the exercise device.

It is an additional object of the present invention to provide an exercise bench that will distribute the force and maintain the stability of the device and yet be allowed to pivot out of the way to allow an unobstructed floor area for other exercises.

It is a particular advantage and object of the present invention to utilize a bar connected to cables at both ends to a single weight source thus allowing each part of the body to operate to failure for more even and balanced muscle development.

It is a further object of the present invention to provide an exercise device but if a lift cannot be completed, the grasping device returns to a position that will not injure the person.

It is the further object of the present invention to provide an exercise device wherein hand grips and barbells are not restricted to any particular plane of motion such that the movement closely simulate that of exercise performed with free weights, however since a single weight is being lifted from two connection points, all of the unbalanced free weights is being eliminated.

It is an object to contain a pulley system which allows for origin of weight resistance from both above and below the person exercising as well as from both sides of his body, while minimizing stress and unbalanced forces on the support frame system.

It is a particular object of the present invention to contain a means of assistance by a helper in completion of a lift which is located away from the exercise area and allow for additional weight to be added to the weight supply system.

It is an additional object to provide a device to allow the completion of all necessary exercises required by a serious body builder or weightlifter without the requirement of large amounts of equipment available only in the most complete gyms.

It is a further object to enable a gymnasium to install several of the devices of the present invention eliminating the requirement of waiting for certain pieces of equipment to become vacant and available.

It is an additional object to provide a device to enable small groups of people to perform the same exercise with minimum effort required to change the amount of weight lifted or the exercise performed.

It is a further object to provide a device that requires a minimum of floor space to perform the complete range of exercises required for serious body building.

It is a further object to provide a device that may be easily disassembled and relocated.

It is an additional object to provide a device that is virtually maintenance free and remains consistent in weight supply and smooth operations with an unlimited lift expectancy.

It is a further object to provide a device to securely contain all auxiliary equipment within the device of the invention eliminating the need for storage and location.

DESCRIPTION OF PREFERRED EMBODIMENTS

Figure 1:
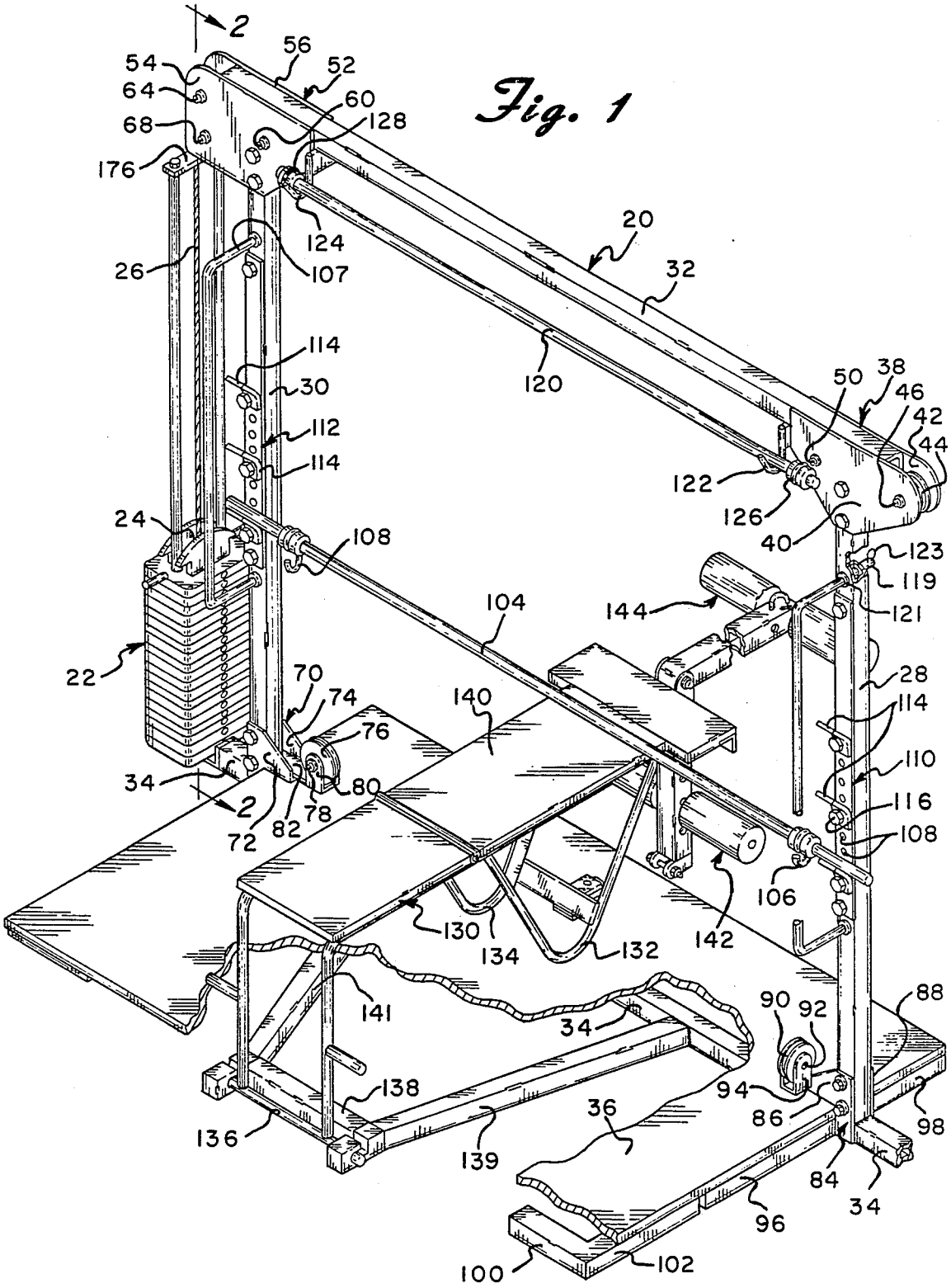
FIG. 1 is a perspective view of a weight lifting exercise device of the present invention.

FIG. 1 illustrates exercise device 20 with all of the frame and support members constructed of two inch thin wall square steel tubing supported and fixed at right angles by attachment through 3/16 inch plates with ½ inch machine bolts and nuts. Single weight device 22 is positioned outside of the exercise area and just outside one of the vertical frame support members and is constructed to allow an adjustable amount of weight to be lifted from single point attachment 24. A chosen number of weights is lifted from device 22 by cable system 26, being lifted upwardly over pulleys hidden in this view. The structural frame device of exercise device 20 includes right vertical frame member 28, left vertical frame member 30, top horizontal frame member 32 and lower floor horizontal member 34 partially hidden in this view extending structurally under one inch plywood floor 36 to complete the frame between the lower ends of vertical frame members 28 and 30. Each corner of the frame is structurally and rigidly connected through the use of 3/16 inch steel plates sandwiching the converging ends of the frame members and connecting them with one-half inch machine bolts passing through the plates and the two inch square tubing. Where no bolts are shown attaching the plates to the tubing, the plates are welded to the tubing to yield a single structural unit. The upper right corner structure unit 38 includes front plate 40 and rear plate 42 which structurally attached and form the upper right corner of the frame. Between plates 40 and 42 upper right outside pulley 44 rides on pin 46 while upper right inside pulley 48 (hidden in this view) rides on pin 50. Upper left corner structure unit 52 including front plate 54 and rear plate 56 structurally attaches the upper end of frame member 30 with the left end of horizontal frame member 32. Supported between plates 54 and 56 are upper left inside pulley 58 riding on pin 60, upper left outside top pulley 62 riding on pin 64 and upper left outside bottom pulley 66 riding on pin 68 (pulleys hidden in this view). Lower left structural unit 70 includes front plate 72 and rear plate 74 structurally connecting the lower end of vertical frame member 30 with bottom floor horizontal frame member 34. Lower left training point location pulley 76 rotates freely on pin 78 and swivels in frame 80 which is structurally attached through member 82 to structural unit 70. Likewise, lower right corner structural unit 84 includes front plate 86 and rear plate 88 structurally connecting the lower end of right vertical frame 28 to bottom floor horizontal frame 34. Lower right training point location pulley 90 spins on pin 92 riding in frame 94 which swivels horizontally to any direction and is structurally attached to lower right corner structural unit 84. Structurally welded to front plate 86 and extending under floor board 36 is horizontal floor side support member 96 while rear floor support member 98 is structurally welded to rear plate 88 extending to the rear under floor 36. Like floor support members extend from plates 72 and 74 on the left side. A wooden space support frame extends under floor 36 and includes front edge two inch wood spacer support and right edge wood support 102. Like wood supports are provided on the left edge, rear edge and intermediate between the weight distributing device supporting the center section of the floor and the edge wood supports. Lift bar 104 is a typical exercise grasping device of the present invention allowing the person to grasp the bar and move it against weight resistance. The lift bar includes two separated connection points here illustrated as cable hooking mechanisms 106 and 108 fixed to attach to cables (not shown here) trained downwardly to pulleys 76 and 90. Lift bar 104 rests at both ends on right racking device 110 and left racking device 112 with each device including "V" shaped resting hooks 114 which may be adjusted to chosen heights with bolts 106 through any of a plurality of holes 108 in the vertical frame members. The racking devices 110 and 112 are of importance to fix the starting position which can be adjusted to the person's height and to determine the height at which weight resistance to lifting or pulling will be realized. Most importantly, it is at this height that all weight will be removed as bar 104 is lowered to that height level. Thus, as bar 104 is lifted out of the starting position, full weight resistance is met, but if the lift is to failure and the person exercising loses control of the bar, the bar drops to the start position at which point there is no further weight being lifted and the bar stops avoiding damage and possible injury to the lifter. Likewise, pull up bar 120 is shown supported and resting on hooks 122 and 124. Safety "U" shaped members 117 and 119, constructed of ½" dia. rod, connect at the ends to vertical frames 28 and 30 through the frames, stopped by washers 121 and attached with spring clips 123 through holes in the ends of the members. Safety members 107 and 119 extend over hanger devices 110 and 112 and upwardly along the length of the vertical members. Approximately two to four inches play is provided between "U" shaped members 107 and 119 and the face of frames 28 and 30 allowing the bar to be lifted vertically between the frame and the safety member. A low friction fluorocarbon polymeric coating may be applied to the safety members so that the bar slides easily upwardly and downwardly when pressed against that member. The safety member restricts the lateral movement of the bar and prevents complete loss of control.

Exercise bench device 130 rests on "U" shaped tubular legs 132 and 134 and pivot tube 136 structurally connected directly to the weight distributing device which includes front frame member 138, and angled frame members 139 and 141 welded to frame 34 to form a trapezoidal shape. Bench exercise device 130 includes inclined bench device 140, leg extension device 142 and leg curl device 144.

Figure 2:
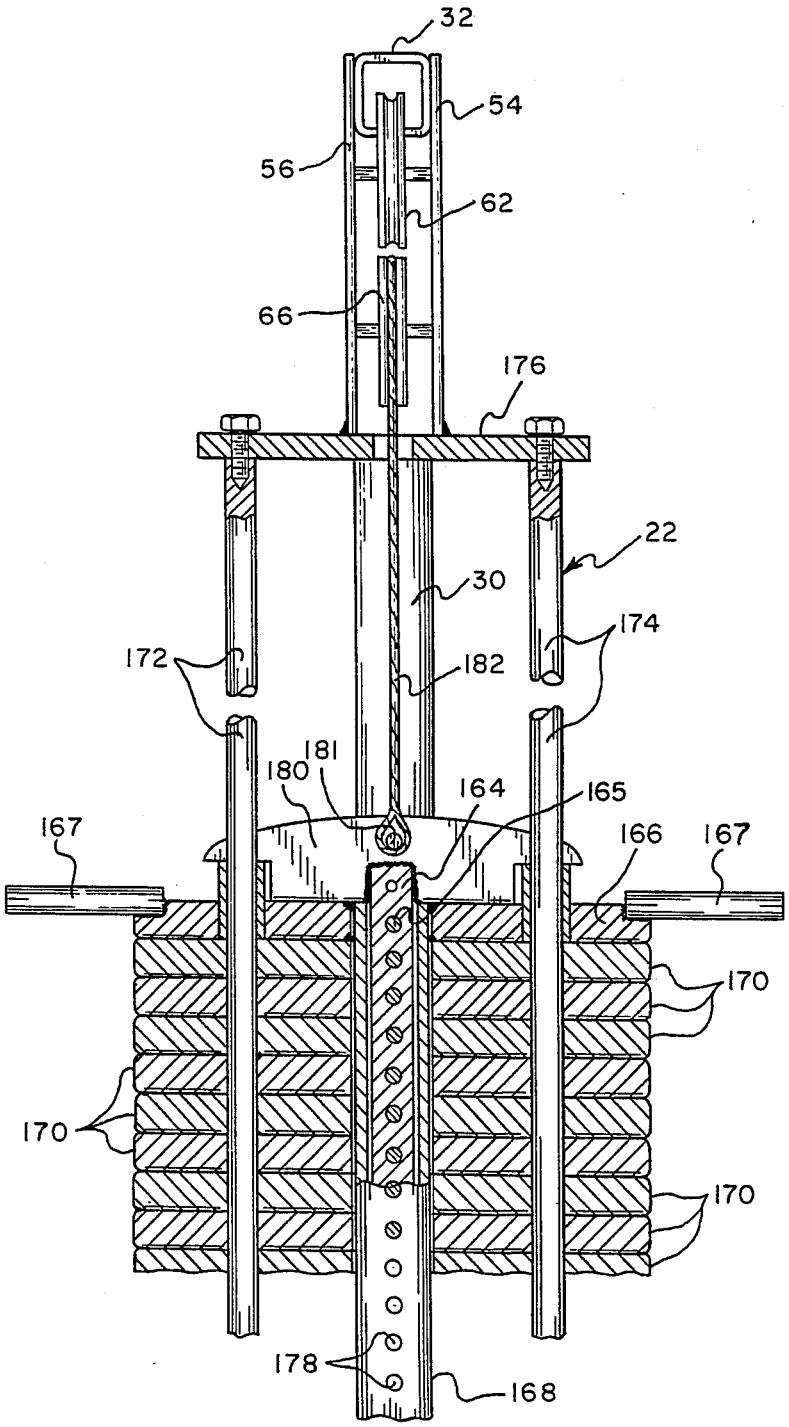
FIG. 2 is a partial cross-sectional view taken along lines 2—2 of FIG. 1.

FIG. 2 illustrates the single weight device which includes an adjustable selector device to allow adjusting the length of the cables to coincide with a chosen height of the grasping element such that at a chosen height all weights are down and exerting no load against the bar. This is accomplished by pin connection of vertical rod 164 through holes spaced along the length of rod to top weight member 166 to which is weldably attached to vertical tube 168 through which rod 164 slides up and down. By connecting the lowest weight member to be lifted with tube 168, the number of weight members to be lifted is chosen. In weight device 22, a stack of "retangular" shaped weights 170 sized 12"×4"×1" are stacked on top of each of other. There are three vertical aligned holes in each weight member one in the center and one on each side through which vertical guide rods 172 and 174 pass to prevent side ways movement of the weight members. Guide rods 172 are supported by horizontal frame 176 to which the rods are rigidly attached extending vertically downwardly to be fixed to a floor member under the weight stack. An alternative embodiment is to provide a square hole sleeve to replace tube 168 and a square cross-section rod to replace rod 164 to prevent twisting of the rod within the sleeve. The tubular member replacing tube 168 may have any interior cross-sectional shape such as hexagon, octagon or any shape that will maintain orientation of the rod and the tube. The center holes are aligned to form a single vertical hole. Tube 168 is structurally welded to top weight member 166 and extends downwardly slideably interfitting in the center hole of all the weight members stacked below it. A plurality of holes are spaced vertically to allow any of the weight members to be chosen as the lowest weight member to be lifted, thus allowing weight variation within small increments. Steel rod 164 is structurally welded to cable attachment member 180 to which cable 182 is connected. The end of cable 182 hooks over removable horizontal pin 181 which is positioned directly above rod 164 through holes in member 80. Rod 164 slideably interfits and extends downwardly into tube 168 and is provided with a plurality of horizontal holes spaced vertically along the length of the rod in about one inch increments to allow accurate adjustment of the cable length and thus the position of the grasping element. In operation, the grasping element is positioned at the chosen starting position thus pulling on cable 182 to a certain height. A pin member 165 is then inserted through the closest hole in rod 164 into a corresponding horizontal hole in top weight member 166. If at this point, the grasping element is moved against the weight resistance, only top weight member 166 will be lifted. If additional weight members are desired to be lifted, a second pin member 165 is inserted through one of the horizontal holes in tue 168 corresponding with the lowest weight member 170 wishing to be lifted. If there is a corresponding horizontal hole available in rod 164, the pin may pass through that hole also providing additional support. In FIG. 2, multiple pins 165 are shown for illustration purposes only as to location. Only two pins 165 maximum are necessary to operate the device. Hand hold cantilever one inch rods 167 welded to top weight member 166 allow a second person to lift the weight attached by pin connection to tube 168 to aid a person doing an exercise.

Figure 3:
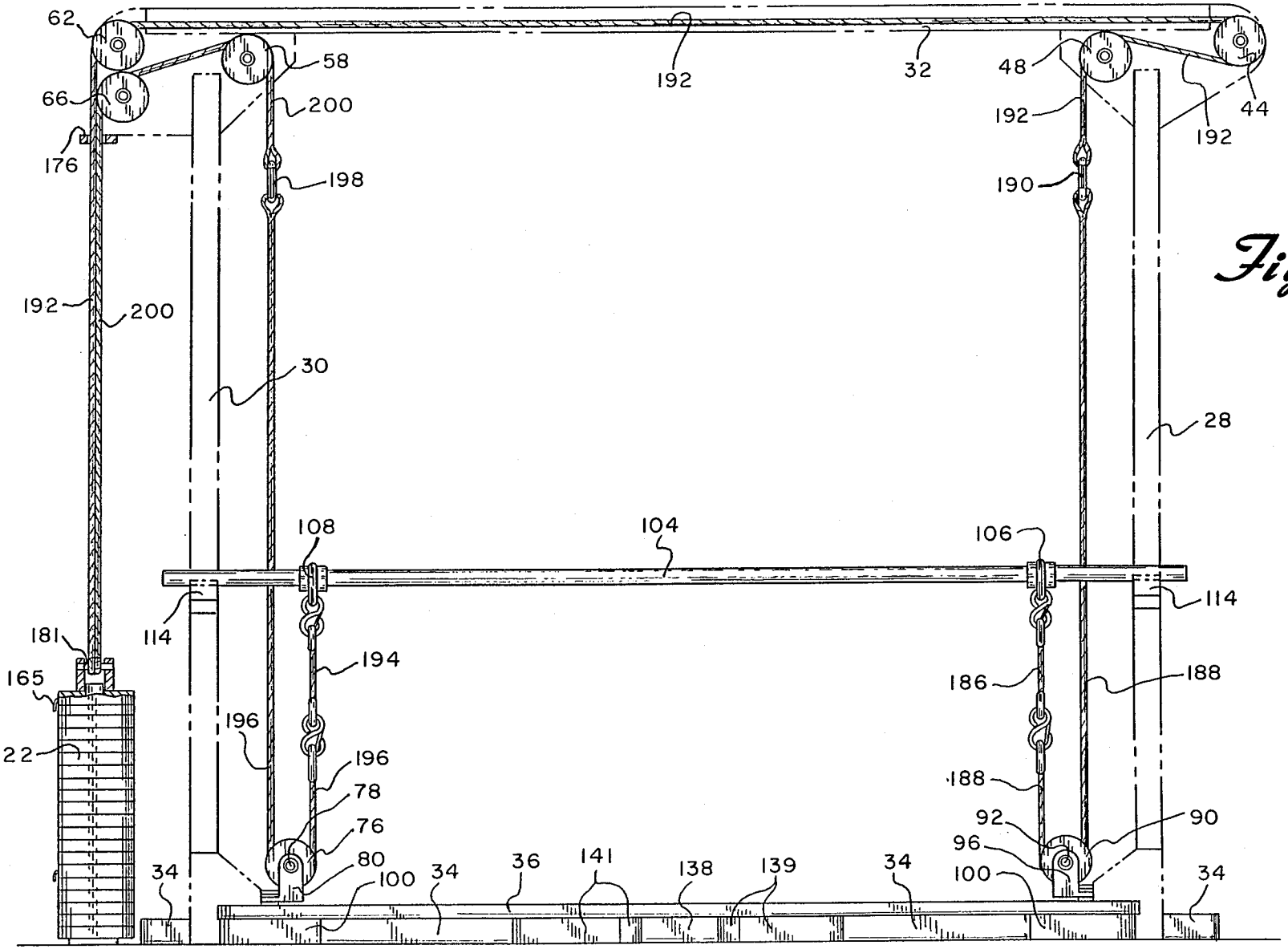
FIG. 3 is a partial front elevational view of the device of FIG. 1 with cables added to demonstrate the configuration for a lifting exercise.

In FIG. 3, the cable and pulley mechanism for a dead lift exercise is illustrated. Further, this Figure illustrates the force distribution of the present invention. A person lifting bar 104 stands on floor 36 distributing all downward force to the weight distributing device including front frame member 138 and angled distributing members 139 and 141 and directly to lower frame member 34 structurally connected to vertical frame members 28 and 30 to prevent any lifting of the frame. Bar 104 is connected to the cable system through cable connection hooks 106 and 108. Right cable connection hook 106 is connected to short cable length 186 which with connection at both ends allows ross adjustments in cable lengths for varying exercises. Right vertical cable 188 trains downwardly around pulley 90 and then upwardly along side of right vertical frame member 28 connecting at cable connector 190 to upper right cable 192 which is trained over upper right inside pulley 48 horizontally to the right and under upper right outside pulley 44 reversing direction and passing through inside top horizontal frame member 32 over upper left outside top pulley 62 and downwardly to single point attachment 24. A separate short cable 194 connects through a cable clip to left cable connection hook 108 and the other end connects through a clip to left vertical cable 196 which is trained downwardly around lower left pulley 76 reversing and trained vertically upwardly along the inside of left vertical frame member 30. Cable 196 connects through cable clip 198 to top left cable 200 which is trained upwardly over upper left inside pulley 58, trained to the left over upper left outside bottom pulley 66 and downwardly to be connected to single point attachment 24. In operation, the person doing the lift exercise positions himself or herself on floor 36 and for example may conduct a dead lift exercise on bar 104. At the start, bar 104 with essentially no weight rests on racking hooks 114 with weight device 22 being adjusted so that there is essentially no weight at that height. As bar 104 is lifted an equal downward force is directed at each connection point 106 and 108 from weight device 22 through the cable system described above. Force from the person doing the exercise is directed downwardly to floor 36 to the weight distributing device and directly to the frame to keep vertical frame members 28 and 30 from lifting. This balancing of the forces maintains complete stability to the device.

Figure 4:
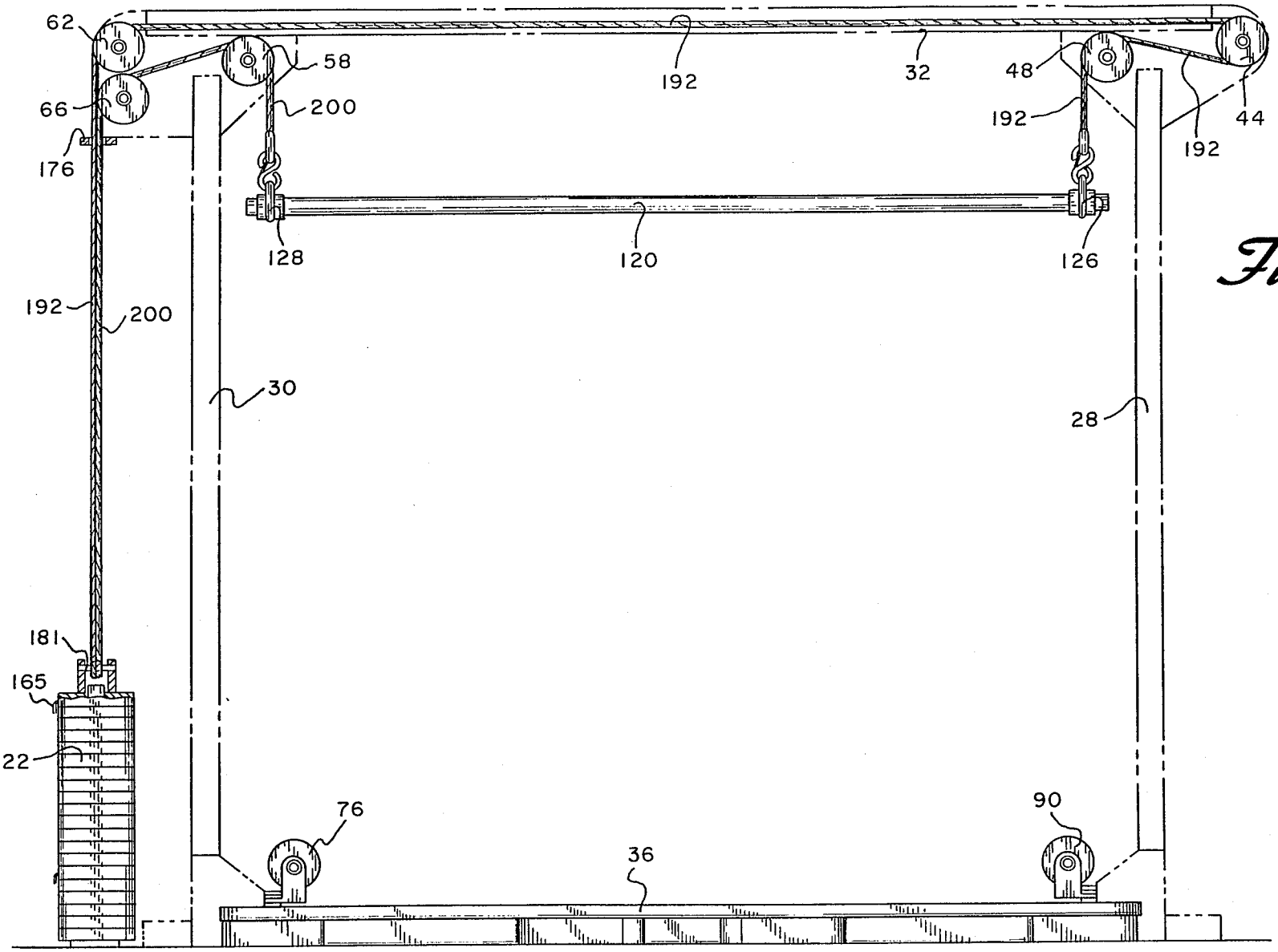
FIG. 4 is a partial front elevational view similar to that of FIG. 3 except the cables are adjusted to allow a pull down exercise.

FIG. 4 is a schematic diagram similar to that of FIG. 3 with bar 120 connected through separate connection points 126 and 128 through clips to upper right cable 192 and to upper left cable 200, both of which are trained over the same pulleys in FIG. 3 and connected to single point connection 24 to weight device 22. This configuration allows the person to perform various downward pulling type exercises. A single point attachment may also be utilized in place of bar 120 being attached to either cable 192 or 200 unhooking the other from the attachment point 24. Either side could then be utilized to lift any desired amount of weight.

Figure 5:
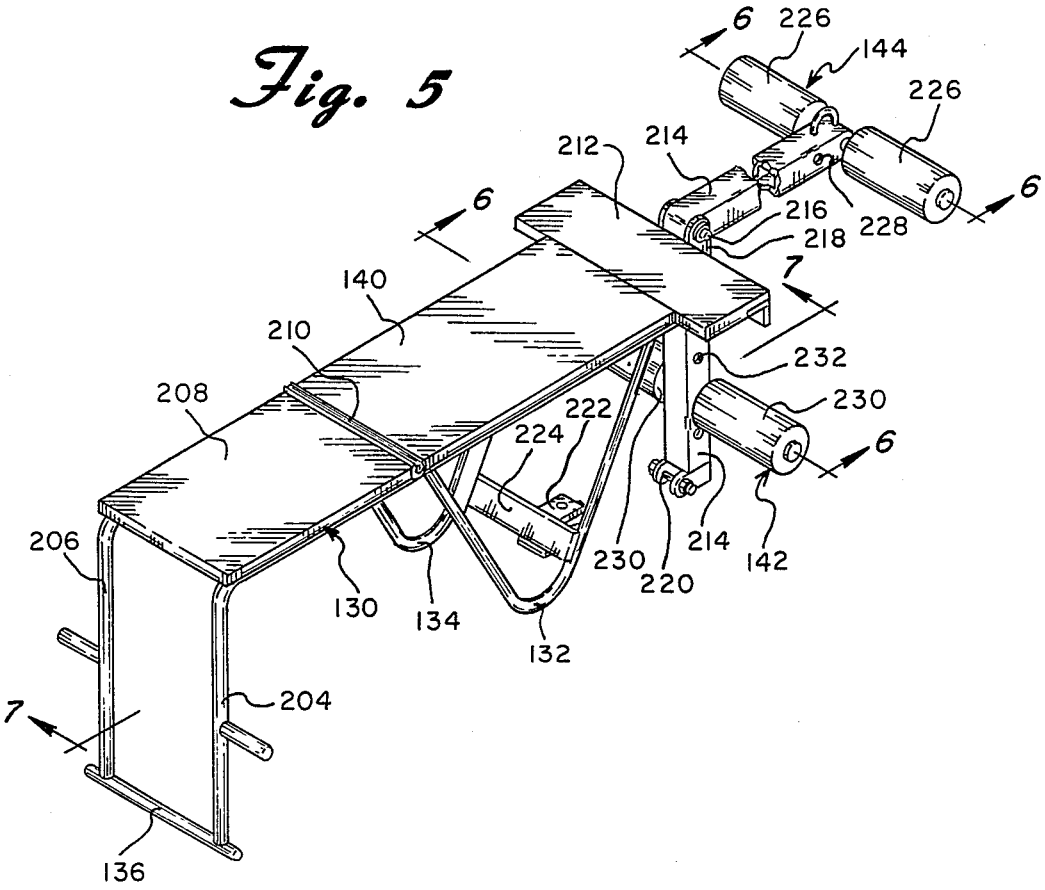
FIG. 5 is a perspective view of the bench exercise device illustrated in FIG. 1.
Figure 6:
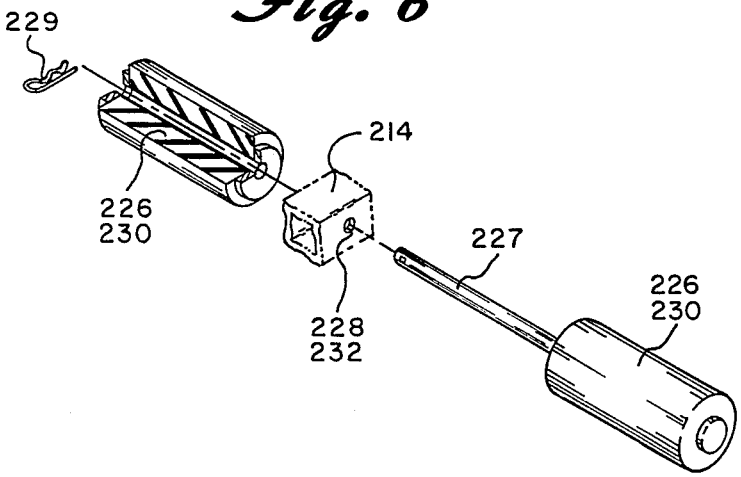
FIG. 6 is a cross-sectional view taken along lines 6—6 of FIG. 5.

FIG. 5 illustrates bench device 130 which may be used for leg extensions, leg curls, shoulder flies, preacher curls, bench presses, leg raises, and various other exercises. The basic frame and leg supports of bench 130 are constructed of one inch thin wall steel tubing generally welded to form the structural elements. Of particular importance is that bench 130 be capable of pivoting completely off the floor area on pivot tube 136. Bottom legs 204 and 206 are welded to pivot tube 136 to support a tubular frame on which lower bench table section 208 is rigidly fixed. Inclined bench section 140 pivots on hinge 210 to an angle over upper bench section 212. Inclined bench section 140 may be adjusted and fixed at chosen heights. Leg extension device 142 and leg curl device 144 is a combination device with base structural "L" shaped frame 214 which pivots on pin 216 held in bracket 218 attached to upper bench section 212. Two cables are connected to cable connection bolt 220 which is positioned proximate to the lower end of "L" shaped member 214. The cables are trained over two pulleys attached to and rotated on bracket member 222 which is structurally attached to cross-member 224 between leg members 132 and 134. In leg curl device 144, foam rubber protectors are slipped over opposite ends of a tube (hidden in this view) which is inserted into a chosen hole 228, a plurality which are horizontally spaced along the upper arm of "L" shaped member 214. Similarly, for leg extension device 142, foam protectors 230 are slipped over a tube (hidden in this view) inserted through a hole chosen from a plurality of holes spaced vertically along the lower arm of "L" shaped member 214. In FIG. 6, a partial exploded cross-sectional view shows rod 227 on which foam protectors 226 have been placed passing through hole 228 of member 214 and fixed on the end with clip 229. Device 142 is similarly constructed.

Figure 7:
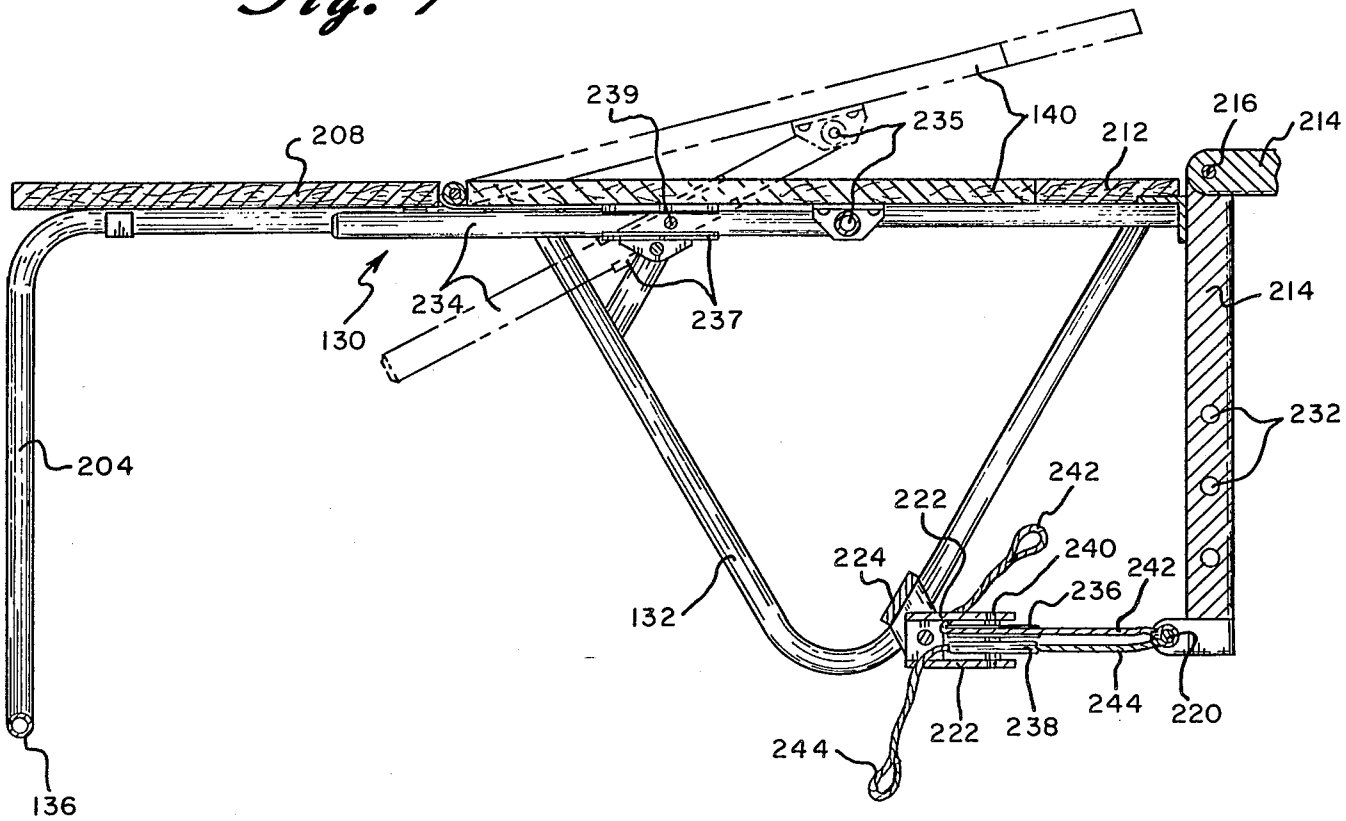
FIG. 7 is a cross-sectional view taken along lines 7—7 of FIG. 5.

FIG. 7 is a cross-sectional view of bench 130 showing pivot support 234 to support inclined bench section 140 at any chosen height. Pivot support 234 attaches to the underside of section 140 through pivot pin 235 and slides freely through pivot tube 237 which tilts as support 234 is angled from the horizontal. Screw lock 239 is threadably connected through tube 237 to fix support 234 at any chosen angle to hold section 140 at any chosen height. Upper bench pulley 236 and lower bench pulley 238 rotate on pin 240 supported in bracket 222. Upper bench pulley 36 is held horizontally to receive cable 242 which is trained to lower left pulley 76 and is ultimately connected through upper left pulley 200 to weight device 22. Similarly, lower bench pulley 238 is held horizontally to receive cable 244 and trained horizontally to lower right pulley 90 and then upwardly ultimately connected to upper right cable 192 and to weight system 22.

Figure 8:
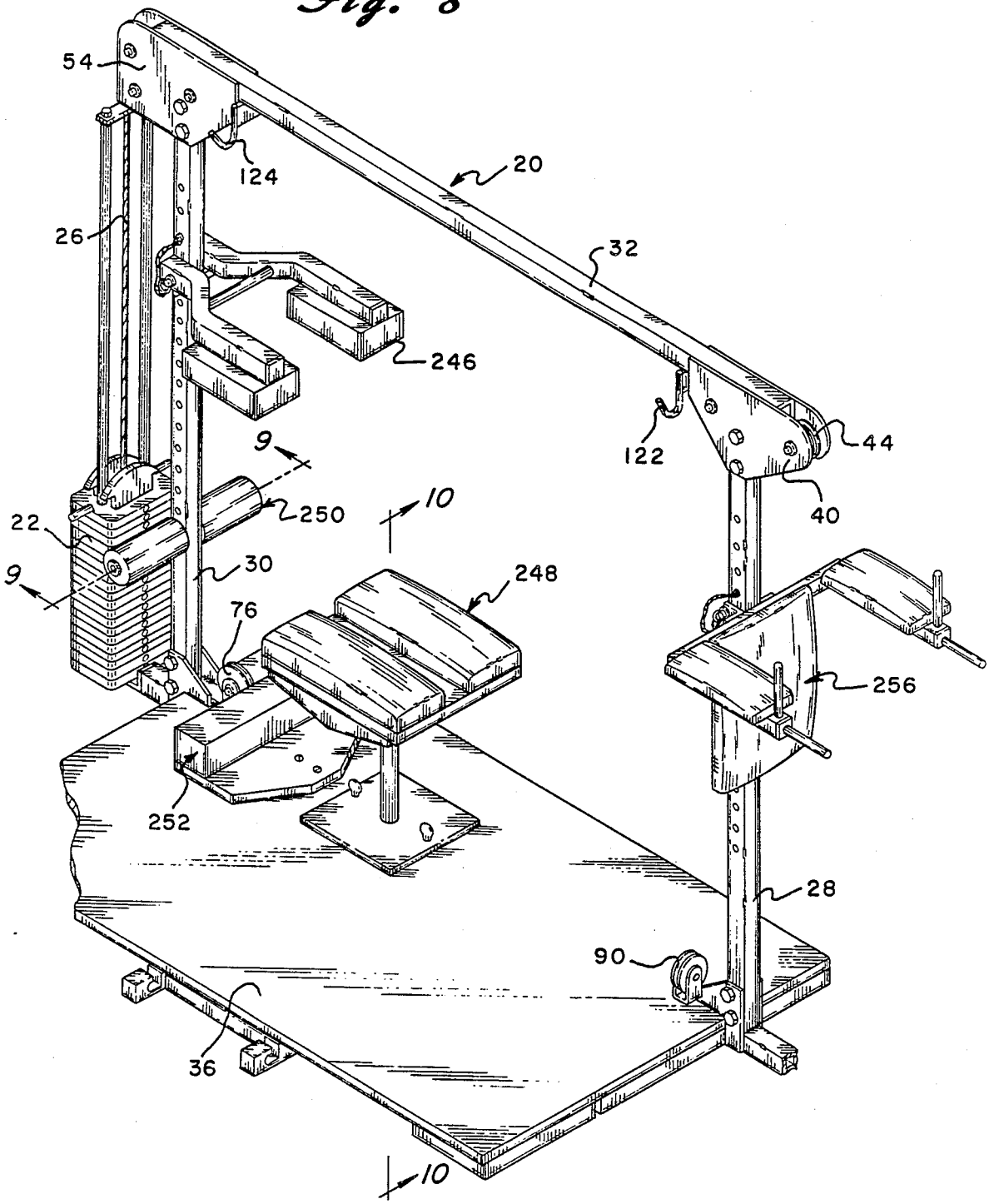
FIG. 8 is a perspective view including certain exercise devices interconnected with the device of FIG. 1.
Figure 9:
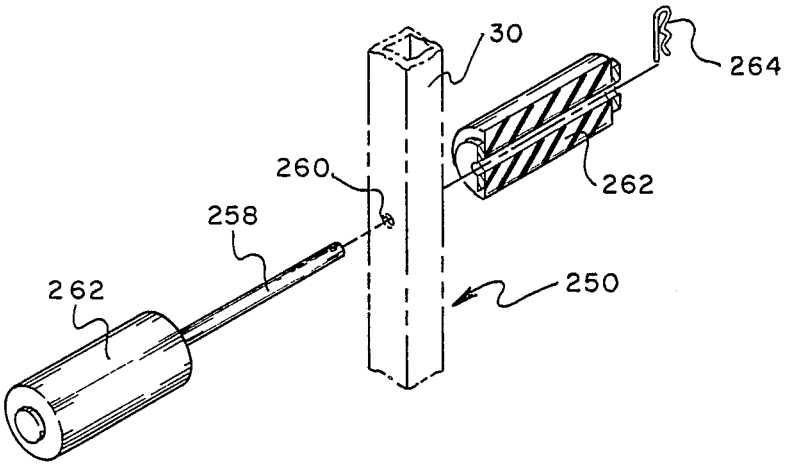
FIG. 9 is a cross-sectional view taken along lines 9—9 of FIG. 8.
Figure 10:
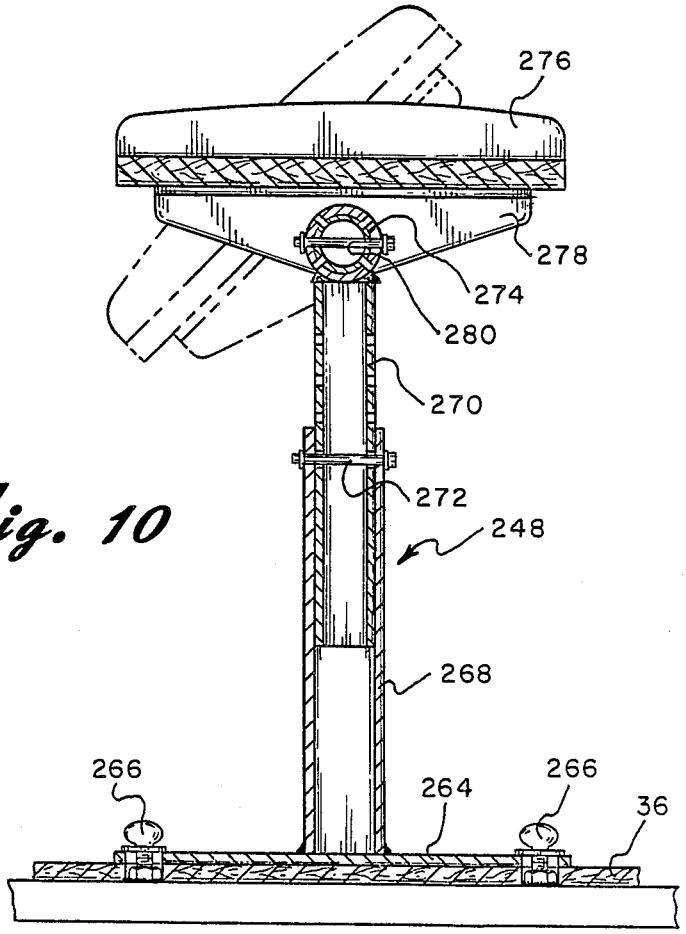
FIG. 10 is a cross-sectional view taken along lines 11—11 of FIG. 8.
Figure 11:
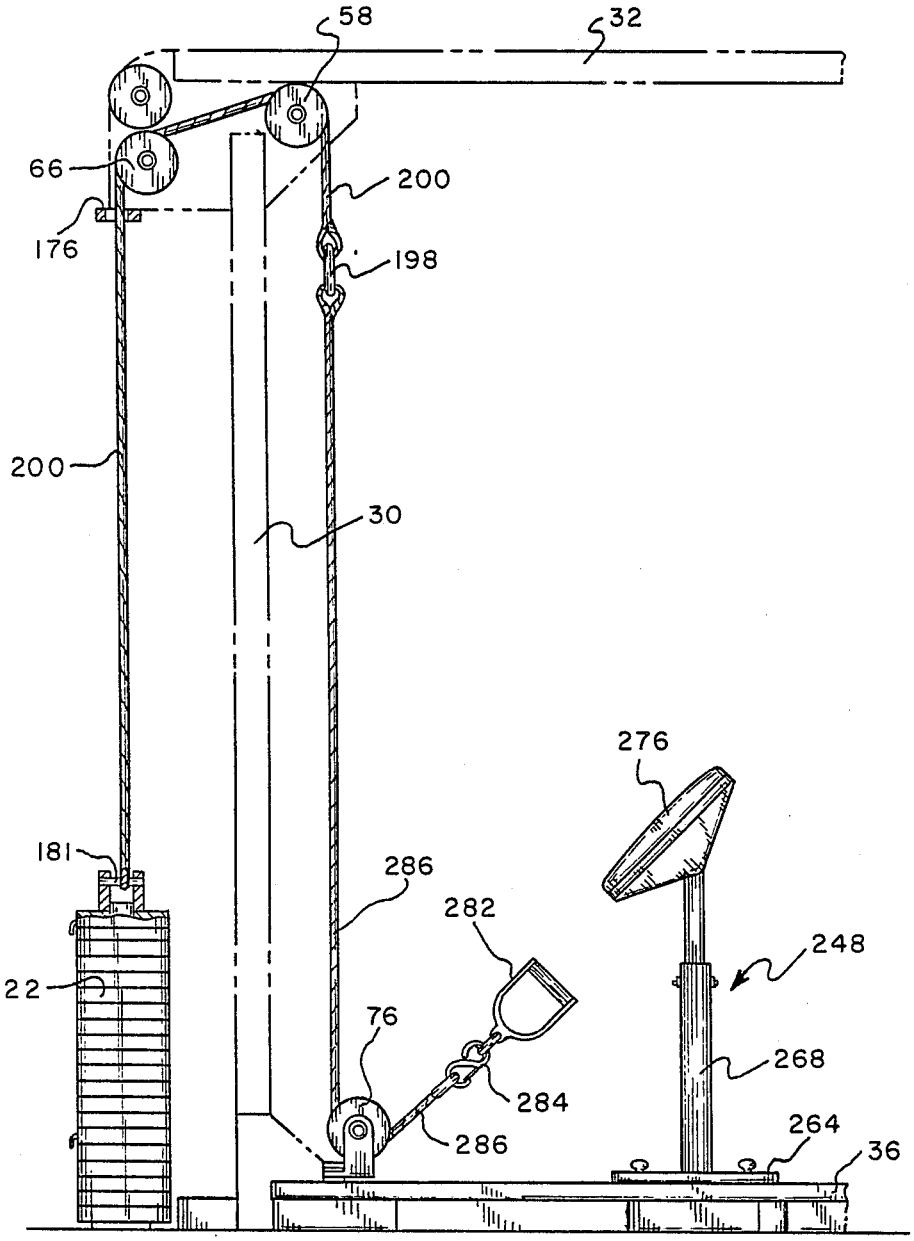
FIG. 11 is a partial front elevational view of a modified device illustrating a pull exercise device.
Figure 12:
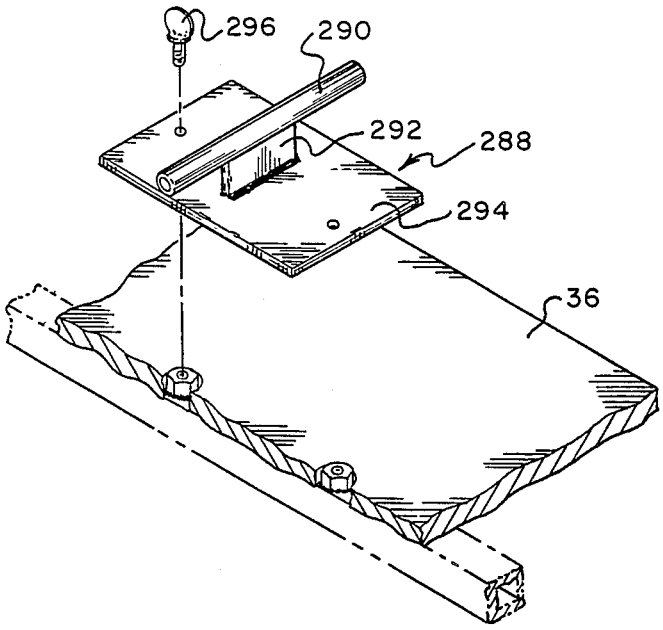
FIG. 12 is an expanded perspective view of a foot stop device used with pulling exercise device of FIG. 11.

FIG. 8 illustrates exercise device 20 with a number of optional exercise attachments to allow multiple additional exercises. These devices include calf raise attachment device 246, preacher curl attachment device 248, foot lock device 250, spacer block device 252, and leg lift and dipping bar device 256. A slant sit-up board attachment may be added. In FIG. 9, an expanded partial cross-sectional view of padded foot lock device 250 shows rod 258 passing through horizontal hole 260 and left vertical frame member 30 to support pad 222 held on with end clip 264. Preacher curl device 248 is best illustrated in the expanded cross-sectional view of FIG. 10 showing base plate 264 attached through thumb bolts 266 to floor 36. Support pillar 268 is welded to base plate 266 and extends vertically to receive upper support pillar 270 which interfits and slides inside of tube 268. Through a plurality of holes through the vertical tubes, pin 272 allows the height to be adjusted. Padded seat 276 rests on frame 278 which is connected through swivel pivot 274 to upper pillar 270. Swivel pivot allows seat 276 to be pivoted to any angle and held in position by pin 280. The use of preacher curl device 248 is illustrated in FIG. 11 where handle 282 is connected through clip 284 to cable 286 which is trained generally downwardly at an angle to pulley 76. Cable 286 is then trained vertically upwardly along side of left vertical frame member 30 to connect through clip 198 to upper left cable 200 which is trained over the pulley system and then downwardly to weight system 22 similar by to that illustrated in FIG. 2. The cable configuration of FIG. 11 may also be used for rowing exercise wherein the person exercising sits on the floor generally facing grip handle 282 and pulley 76. Rowing foot attachment device 288 is illustrated in FIG. 12 including 1 inch diameter steel tube 290 welded to vertical support member 292 which in turn is welded to horizontal base plate 294 which is attached to lower frame member 34 wing bolts 296.

Figure 13:
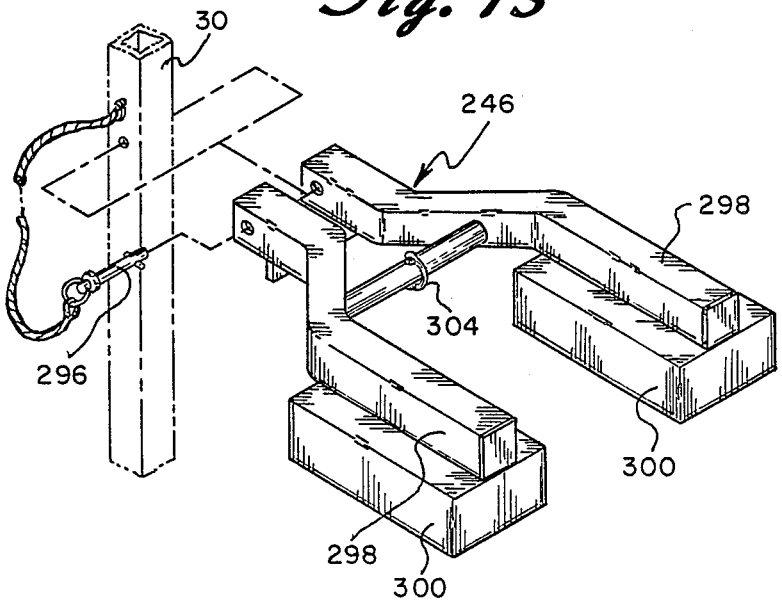
FIG. 13 is an expanded perspective view of the calf raise attachment device illustrated in FIG. 8.
Figure 14:
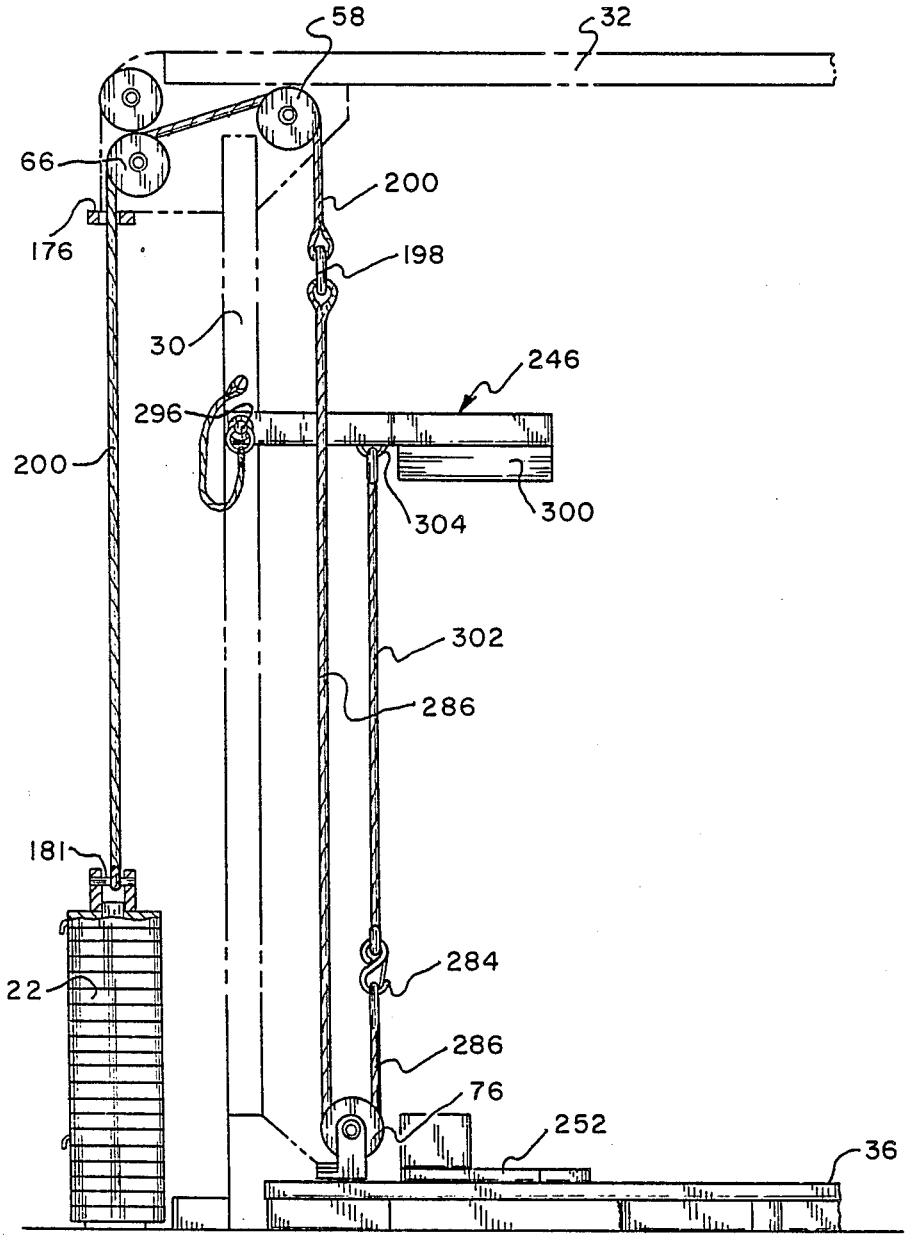
FIG. 14 is a elevational view of the device of FIG. 8 illustrating the calf raising device, with cables added.

Calf raise attachment device 46 is best illustrated in FIG. 13 as shown pivotally attached to left vertical frame member 30 through pin 296. The device is basically a "Y" shaped frame member of 2 inch square tubing 298. At the base of the "Y" shape it sandwiches frame 30 and is held in position by pin 96 passing through both legs of the base of the "Y". The wide section of "Y" shape fits around the person's head and rests on the shoulders with foam pad 300 between the frame and shoulders. Thus, the "Y" shape is able to be pivoted upwardly and downwardly from the pivot point. In FIG. 14, Calf raise attachment device 246 is shown in position pivoting on pin 296. Cable 302 is attached to hook 304 in the middle of "Y" frame 298 and is trained downwardly and attached through clip 284 to cable 286 which passes around pulley 76 and reverses passing upwardly vertically to connect through clip 198 to upper left cable 200 and thence to weight system 22.

Figure 15:
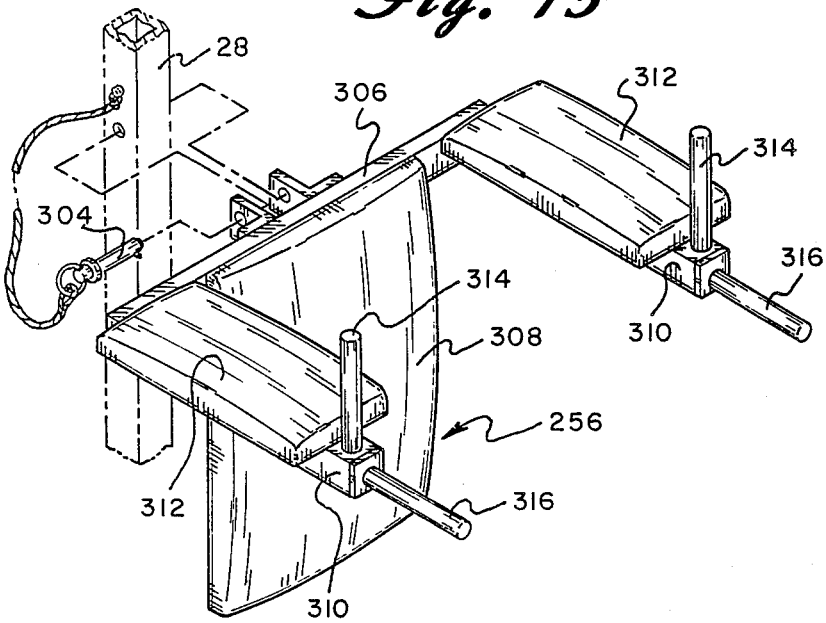
FIG. 15 is an expanded perspective view of the leg lift device apparatus illustrated in FIG. 8.

Spacer block device 252 is utilized to obtain further extension of the calves by placing the persons feet onto the block. Leg lift and dipping bar device 256 is further illustrated in FIG. 15 attaching through pin 304 to right vertical frame member 28. Device 256 includes a vertical support base member 306 which is connected through pin 304 and rests against the outside surface of frame member 28. Pad 308 is attached vertically against the outside surface of base frame 306 to protect the person. Arm support cantilever members 310 are structurally welded to the top edge of vertical frame 306, extend outwardly and protect the person with pads 312. Vertical hand grips 314 extend upwardly from the ends of cantilever arm rests 310 while horizontal hand grips 316 for dipping extend horizontally from the exposed ends of cantilever arm rests 310.

Figure 16:
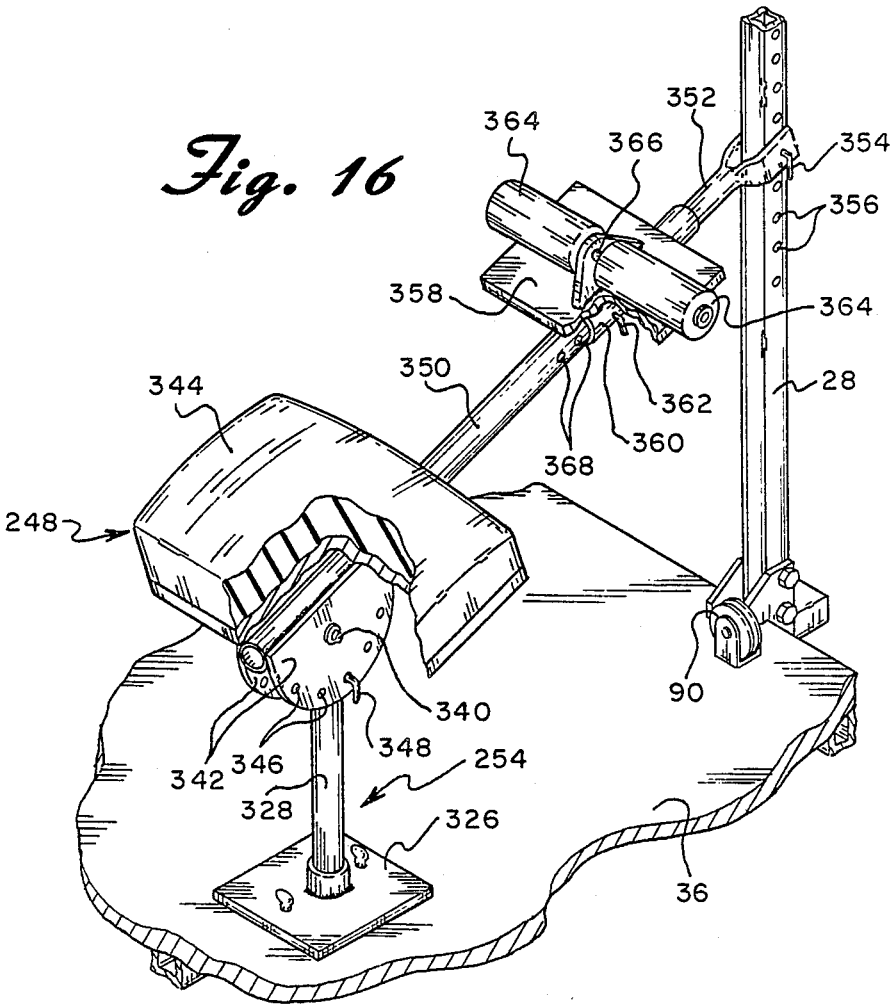
FIG. 16 is a perspective view of a novel multi-purpose inclineable sit-up device used in the present invention.

Combination device 254, as an alternative to device 248, is pictured in FIG. 16 attached through base plate 326 bolted through thumb bolts to base frame member 34. Structurally attached to bracket 326 is pedestal pipe 328 constructed to two inch diameter steel pipe which is attached to the seat at the top through pin 340 passing through tilt support plates 342 positioned vertically and riding on pin 340. Support plates 342 are welded to a base plate of cushion 344. Holes 366 through support plate 342 are capable of alignment with a horizontal hole through pipe 328 through which pin 348 is inserted to fix seat cushion 344 at a chosen angle. Angle member 350 is welded between plates 342 so that it extends essentially parallel to the top of cushion 344. Telescoping section 352 allows it to vary in length while hole 354 is attached at chosen heights to vertical frame member 28 through holes 356. A foot locking mechanism is constructed on base plate 358 welded to "U" shaped frame 360 attached to member 350 through complimentary holes and pin 362. Padded rollers 364 slip over the ends of rods 366 which is positioned at a height allowing the toes to slide under and allow the feet to be locked under. The foot lock mechanism can be adjusted along member 350 through a plurality of holes 368.

Figure 17:
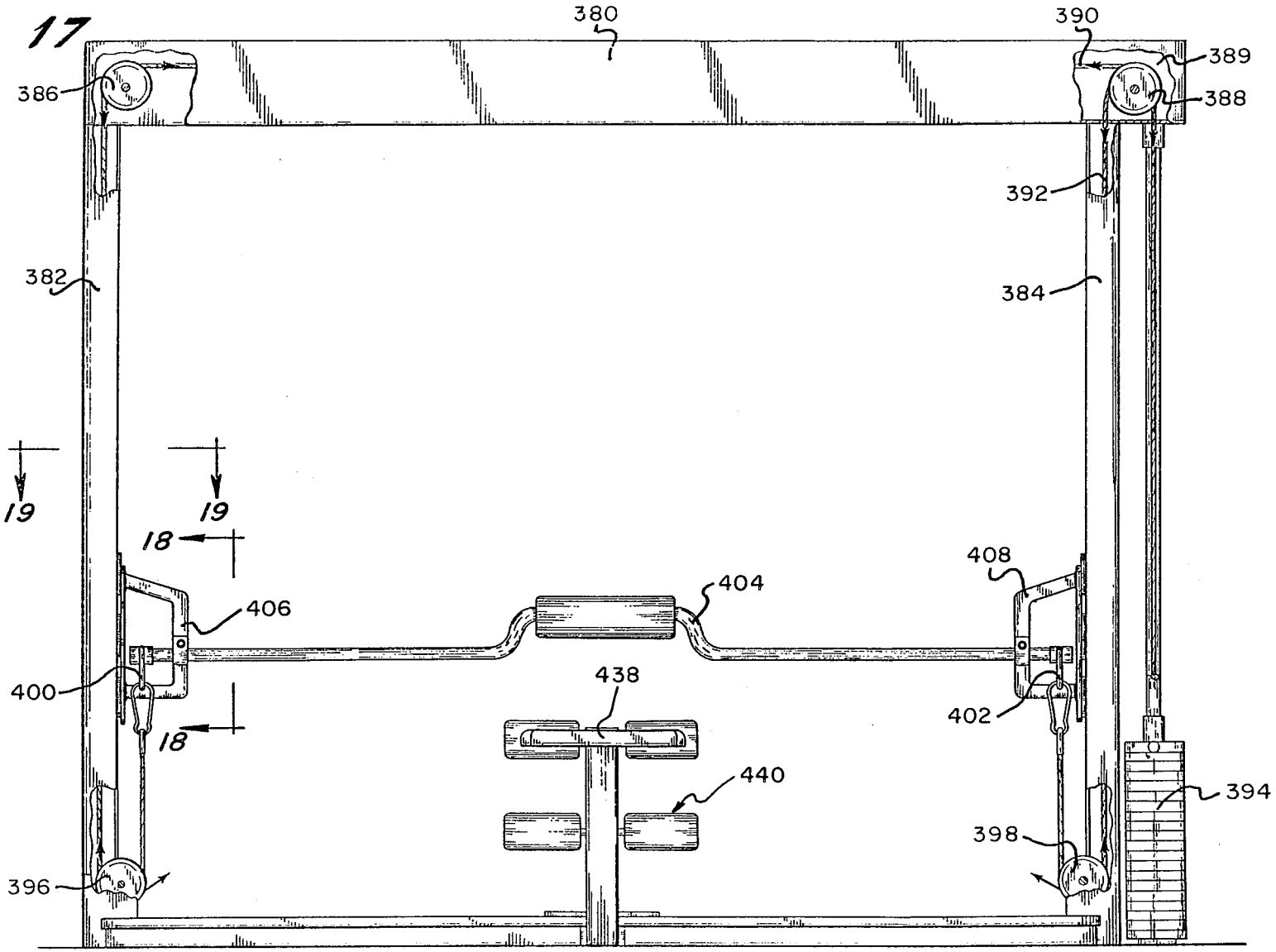
FIG. 17 is a frontal elevational view of an alternative embodiment of the present invention.
Figure 18:
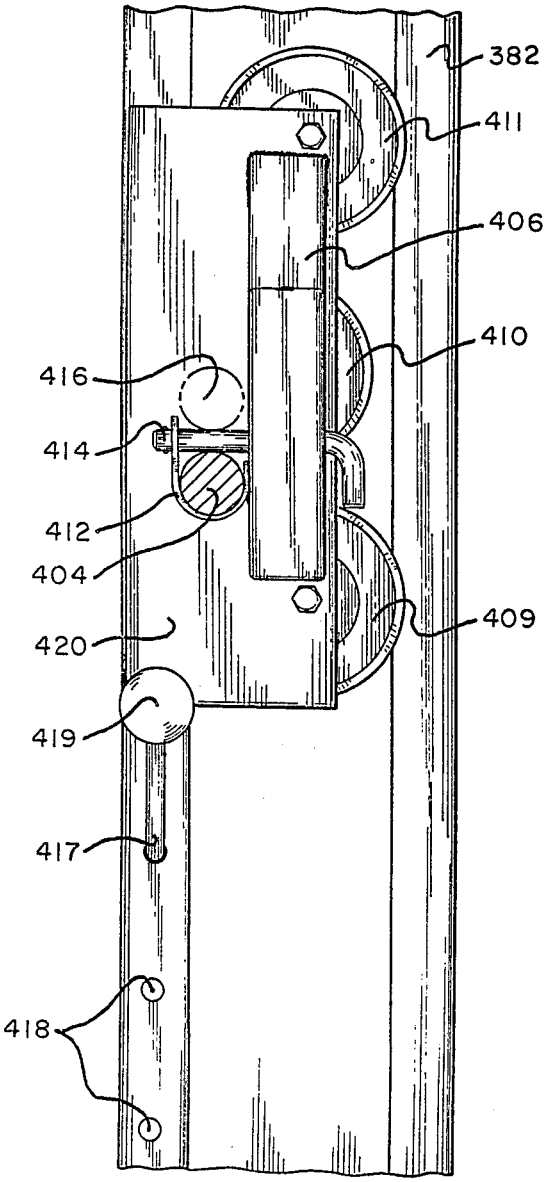
FIG. 18 is a partial cross-sectional view taken along lines 18—18 of FIG. 17.
Figure 19:
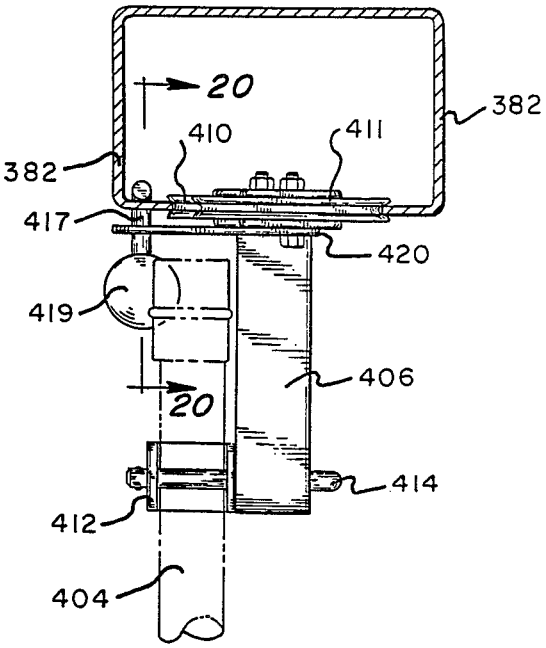
FIG. 19 is a cross-sectional view taken along lines 19—19 of FIG. 17.
Figure 20:
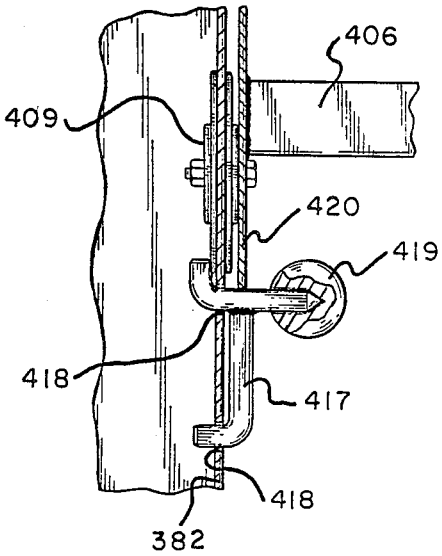
FIG. 20 is a cross-sectional view taken along lines 20—20 of FIG. 17.

In FIG. 17, an alternative embodiment is illustrated wherein the entire structure is constructed of sheet metal wherein the frame members are welded together or held together with fasteners. The frame members are constructed of one-eighth inch thick sheet metal and have a cross-sectional area of about six inches by about six inches. The pulleys are essentially hidden as they are positioned inside the hollow frame members. The frame is constructed of upper horizontal frame member 380 constructed in a "U" shape opening downwardly and vertical frame members 382 and 384 each constructed in a "C" shape opening inwardly to the frame structure. The support frame members and floor construction is similar to that illustrated in FIGS. 1 and 3. Upper pulleys 386 and 388 receive the vertically trained cables 390 and 392 to train the cables toward the single point weight source 394. Pulley 389 is positioned behind pulley 388 in this view and is essentially hidden receiving cable 390 that was trained in a horizontal direction and training the cable downwardly to single weight source 394. Lower pulleys 396 and 398 are fixed to rotate inside vertical frame members 382 and 384 reversing and training cables 390 and 392 toward point connections 400 and 402 on grasping bar 404 which is a "chambered" bar formed in a generally upward "U" shape in the center to facilitate its use in some exercises. The ends of bar 404 rest on carriages 406 and 408 which ride vertically along vertical frame member 382 and 384. Carriages 406 and 408 provide safety guides when control is desired to prevent the bar from moving horizontally front to back of the frame plane. The carriages also provide a resting place and a stop position depending upon the cable length adjustment described herein above. The ends of bar 404 may be interlocked with the carriages to be held in position in all directions or may merely rest on the carriages which support the bar vertically upwardly and to the sides. In FIG. 18, carriage 408 is shown engaged in "C" shaped vertical frame member 384 riding on wheels 409, 410 and 411 freely along the length of the frame members. The wheels are positioned such that top wheel 411 rides on the right hand side edge of frame member 384, middle wheel 410 rides on the left hand side edge of member 384 and lower wheel 409 rides on the right hand side of member 384 similar to the top wheel. This alternating configuration allows free rotation of the wheels in one direction on one edge without resistance from the other edge on the same pulley. At least three wheels are required and a four wheel configuration may be used with two wheels riding on each side further stabilizing the carriage. Both opposing edges of "C" shaped member 384 may also be covered by nylon polymer type strips to provide a quiet and smooth rolling surface for the wheels. The end of bar 404 is illustrated in the locked position resting on rest support member 412 formed as an integral part of carriage 408 allowing the bar to be supported at both ends and locked into position with locking pin 414 which holds the bar downwardly in the rest support member 412. As illustrated in shadow view 416 bar 404 may also rest on the top of locking pin 414 in a free position and merely be supported from below and the sides. In FIG. 19, the cross-section illustrates vertical frame member 384 with its cross-section being a "C" shape with its opposing exposed edges engaging wheels 409, 410 and 411 allowing carriage 408 to ride upwardly and downwardly freely along the length of the vertical member. The vertical position of each carriage is set on the vertical frame member 384 by inserting pin 417 into holes 418 located evenly spaced in two inch increments along one inside surface of each vertical frame member 382 and 384 as shown in FIG. 20. Grasping ball 419 is utilized to grasp pin 417 for removal and relocation at the desired vertical height at which the wheel support plate 420 is allowed to sit directly on the top of pin 417 supporting the carriage vertically. The carriages remain free to be lifted as a guide for the barbell 404 when exercising with bar 404 locked in support member 412. The double "L" shaped rod welded construction of pin 417 engages into two holes 418 simultaneously, restricting excessive movement of pin 417 when in operation. Due to its configuration the pin is easily removed by pulling out the lower pin-hole connection point first then rotating the ball 419 upward and removing the upper pin connection.

Figure 21:
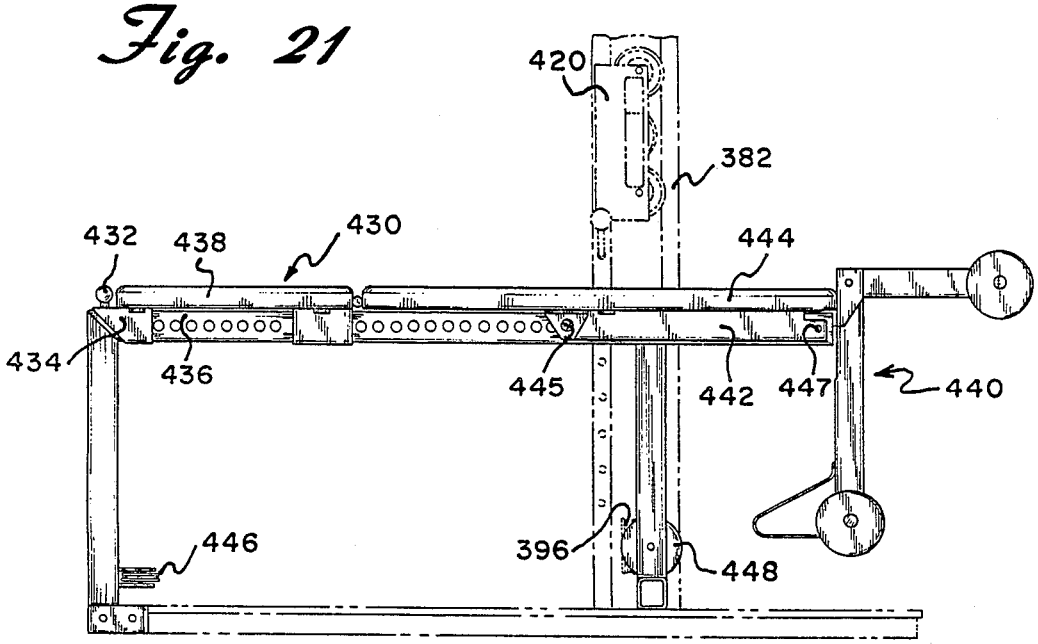
FIG. 21 is a side view of a preferred exercise bench.
Figure 22:
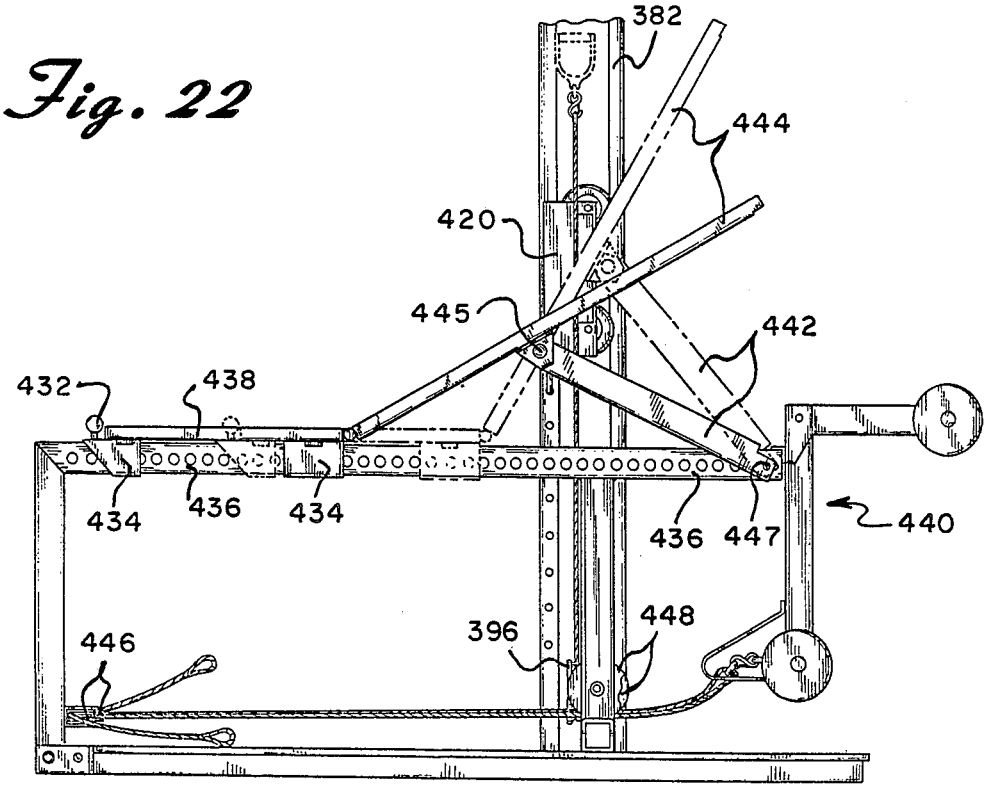
FIG. 22 is a side view of the preferred exercise bench illustrated in FIG. 21 illustrating automatic inclining mechanism movement.

FIGS. 21 and 22 illustrates a incline bench embodiment to be utilized in a similar fashion to that of bench 130 illustrated in FIGS. 5 to 7. This preferred bench 430 provides an added feature wherein the inclining portion 432 of the bench automatically inclines as locking pin 432 is lifting out of its securing holes through sliding frame 434 into bench frame 436 as bench seat 438 is slid toward the leg exercise apparatus 440. The latter being similar to devices 144 and 142. The lengths of bench seat 432, raising seat 444, and pivot arm 442, and connecting points between the parts and to the bench frame 436 assure that, as the raised seat 444 is inclined the position translates behind the possible positioning of the barbell attachment providing the proper positioning of the inclined seat portion at any selected level of bar height and seat incline angle. Seat 438 is structurally attached to sliding frame 434 which rides free along the top of frame 436. Raised seat 444 is hingeably attached at one end to the front edge of seat 438 allowing it to incline upwardly as seat 438 is slid to the front. Pivot arm 442 is pivotally connected at one end 445 to an intermediate position under seat 438 and at the other end 447 to frame 436 proximate the front end to provide support seat 438. Cable attachment to the leg extension/curl device 440 is achieved through training of the cables from each side of the machine main frame pulleys 396 and 398 to pulleys 446 located at the rear leg of the bench frame 436 then trained to pulleys 448 at the front leg and finally secured to leg exercise mechanism 440.

The exercise device includes a support platform to hold and support a person doing exercises and any auxiliary equipment used in the exercises, to direct forces downwardly from the person or the auxiliary equipment, a frame comprising two vertical frame members, each having an upper end and a lower end, a lower support member structurally and rigidly connecting the vertical frame members proximate to the lower end, and an upper support member structurally and rigidly connecting the vertical frame members proximate to the upper end, a weight distributing structure to distribute countervailing downward force from any exercise being conducted by a person from the support platform to the lower support member, a single weight device to allow an adjustable amount of weight to be lifted from a single point location outside one of the vertical frame members, an exercise grasping device to allow the person using the device to grasp and move against a weight resistance, wherein the grasping means comprises a single grasping element, having two separated connection points, pulleys attached proximate to the inside corners of the frame, and a cable system including two separate cables connecting the two connection points trained to the training point locations pulleys and thence to the single point location on the single weight device, wherein movement of either connection point lifts the single weight device. The single weight device preferably includes an adjustable selector length device which allows the positioning of the length of the two separate cables that must be pulled before any weight is lifted. It is preferred that an adjustable racking device be structurally attached to the vertical members of the frame to allow a grasping bar to be set into the racking means at any chosen height. The adjustable selector device allows adjusting the length of the cables to coincide wit a chosen height in the adjustable racking device in which the bar is set where all the weights are down and exerting no load against the bar. The preferred device further includes a pulley force distributing means to distribute forces from the single weight means to both sides of frame from above or below the exercise's position while minimizing unbalanced stress to the frame.

It is preferred that the device include two vertical frame members approximately seven feet tall, located approximately seven feet apart. These vertical frame members are structurally connected at the top and bottom to form a rigid square frame incapable of deformation. It is preferred that the device include a grasping device that is a horizontal bar resting on a pair of carriages that ride vertically on wheels along vertical frame members of the frame device. It is preferred that the vertical frame members have a "C" shaped cross-section opening to the inside of the frame. In this embodiment, a par of carriages are engaged to ride up and down vertically inside the "C" shape where each carriage includes a resting device to provide support on which the end of the grasping device, such as a bar, rests. The resting device may include a locking device to hold the end of the bar to the resting place. The preferred carriage have at least three wheels aligned vertically to engage the opposed, exposed edges of the vertical frame member such that the carriage is held in the vertical position and may ride up and down the frame member freely. It is also preferred that the vertical height of each carriage be easily located and supported by a pin-type system which allows for free upward movement of the carriage at any time. The wheels are misaligned horizontally such that two outside wheels engage only one exposed edge of the "C" frame and the inside wheel engages the opposite exposed edge of the "C" shaped frame. This device is preferred over the safety members 107 and 119 illustrated in FIG. 1. It is preferred that a horizontal exercise bench be centered between the vertical frame members and perpendicular to the top and bottom horizontal frame members. This bench is attached to the floor and pivots up and out of the area between the vertical posts when not in use. This enables the person doing the exercises to stand between the posts when the bench is pivoted out of the way. The bench has the capability of conversion of an inclined bench and contains the apparatus required to perform two essential leg exercises, leg curls and leg extensions. The wooden floor constructed of one inch plywood is approximately four feet wide by seven feet long and covers and transmits force to the weight distributing device which is structurally attached to the frame. The wooden floor is preferably carpeted making it very comfortable to exercise on.

The location of the weight device is on one side of the machine, outside the area enclosed by the vertical frame members. It is typically located about six inches outside of a vertical frame member and the weights travel up and down along the outside surface of that vertical member. "S" type safety hooks are used to connect various cables throughout the system which are preferably equipped with eye connectors on each end. In order to perform the large number of exercises, various lengths of cables are supplied. They may be connected in a variety of combinations to allow accurate choice of starting positions before weight resistance is meet. The device preferably includes four point locations of pulleys, that being that pulleys train the cable to the weight device are located at each corner, top and bottom of the frame. This location of the pulleys allows the entire group of dumbells type exercises to be performed where resistance has to originate on both sides of the body. It is important that the cables on both sides of the frame originate from the same single stack of weights and weight connection. The two sides of the cable system always remain exactly even in position and resistance. Thus, if one side of the person's body weakens the other side can compensate, retaining very strict form in completing the exercise. With dumbells, as one side weakens, the exercise becomes very unbalanced and must be stopped. With the present device, training to failure of both sides of the body is possible. A similar advantage exists with other barbell exercises such as bench presses and military presses where with the present device, both sides of the body may be trained to failure without danger of injury.

As is apparent from the above description, exercises may also be performed by using only one side of the apparatus. The second cable merely unhooks from the weight stack and secured in a location along the vertical frame. Single cable exercises include one arm curls, stomach exercises, close grip back and tricep exercises as well as one arm shoulder and back exercises. An important advantage of the present device is the speed and efficiency in switching from one exercise to another so that there is little wasted time as with other all-in-one gym equipment. In fact, it is easier to switch exercises with the present device than it is when using free weights.

A few of the major exercises being able to be performed on the present device are described below. These exercises have been grouped according to the part of the body to be developed:

For the chest, bench press exercises usually uses the bar hooked to lower pulley while the person lies flat on the horizontal bench. The dumbell fly exercises utilizes separate handles hooked to lower pulleys with the person lying flat on the horizontal bench. For incline fly and bench exercises the same position with the bench in the inclined position with the adjustable selector in the single weight device utilized to locate the bar in the desired position before weights are lifted. For the cable cross over exercise, separate handles are hooked to upper pulleys with the person standing centered between the vertical frame members to pull the handles downwardly to below the chest and towards each other.

For the back, the chin up exercise uses the bar set into permanent hooks on the top of the frame close to the top horizontal frame member. The lat pull exercise utilizes the hook directly to the upper corner pulleys with the person kneeling centered on the floor pulling the bar downwardly. The close grip pull utilizes handles hooked to an upper pulley on one side of the device with the person sitting or kneeling on the floor pulling downwardly. The seated row exercise utilizes handles hooked to either lower pulley on one side of the device with the person sitting on the floor pulling in a rowing motion. For the dead lift exercise, the bar is hooked to cables trained around the lower corner pulleys with the person standing on the bench or on the floor pulling upwardly from a bent over position.

For the legs, the squat exercise uses the bar hooked to cables trained around the lower corner pulleys with the person standing centered on the floor with the bar on the shoulders, squatting down and standing back up. For this exercise, the adjustable height selector and the weight device are utilized to determine the depth of the squat desired. The leg extension exercise utilizes cables hooked to the leg apparatus on the horizontal bench with the person sitting on the bench lifting the lower pads outwardly and upwardly to the horizontal position. The leg curl exercise is accomplished with the cables hooked to the leg apparatus on the horizontal bench with the person lying on his or her stomach and lifting the upper pads from the horizontal position to the vertical.

For shoulders, the military press exercise uses the bar hooked to cables trained around the lower pulleys with the person sitting on the horizontal bench with the bar on the person's shoulders and is then pushed upward to extended arm position. Again the adjustable selector in the weight device is used to locate the bar at the desired shoulder level. The upright row exercise uses the bar hooked to cables trained around the lower pulleys for the person standing in the center of the floor and lifting the bar upward to just under chin position. The same exercise may be done using one side of the machine singularly hooked to a short center connected bar approximately 2" long. The shoulder flies exercise uses handles hooked to cables trained around the lower pulleys with the person sitting on the bench or standing raising the handles over the head and back down.

For biceps development, the barbell curl exercise uses the bar hooked to cables trained around the lower pulleys with the person standing centered on the floor and curling the bar upwardly. The concentration curl exercise uses one or two handles hooked to cables trained around the lower pulleys standing in the middle of the floor and curling the handles upwardly. The preacher curl exercise uses the bar hooked to cables trained around the lower pulleys while placing the triceps against an inclined bench and curling the bar upwardly.

Triceps are developed by a push down exercise with the bar hooked to the upper pulleys with the person standing on the floor and forearms extended outwardly pushing down toward the floor. The close grip push down exercise uses a handle hooked to one of the upper pulleys and the person standing facing the vertical post pushing downwardly from a bent arm position. The close grip bench presses uses the bar hooked to cables trained around the lower pulleys the person lying flat on the bench and hands in closed grip on the bar pushing upwardly to extended position. The overhead push out exercise is accomplished with the back against a vertical post with a cloth strap hooked to a cable to the over head pulley and extending the arms outwardly to a horizontal position.

The calves are developed with standing calf raise exercises with the bar hooked to cables trained around the lower pulleys with the person standing centered on the floor with the bar on his or her shoulders and raising the heels off the floor and back downward with a block under the feet sometimes used. The bar should be locked into the carriages such that it can travel only vertically eliminating the danger of losing one's balance. Calf raise attachment device utilizes the shoulder pads extending outwardly for the vertical post with the device hooked to a lower pulley with the person standing facing the post and raising heels off the floor against the shoulder pads.

The stomach is developed with stomach crunch exercises with a handle hooked to one of the upper pulleys and the person kneeling on the floor facing that vertical post with the hands holding the handle above the head to curl the stomach downward until his elbows reach his knees. The leg raise exercise places the person flat on the bench lifting the legs toward the chest. These exercises are only to give an idea of the utility of the machine and there is a vast number of other exercises possible with this machine. In the interest of brevity the other exercises An alternative to the positioning of the pulley-cable system includes the location of a pivot at the center of each vertical frame member to swing the lower pulleys up to the top achieving the same result as the pictured device. In addition, the inside corner pulleys on the top may be on a swivel to a horizontal axis parallel with the bar.

While this invention has been described with reference to the specific embodiments disclosed herein, it is not confined to the details set forth and the patent is intended to include modifications and changes which may come within and extend from the following claims.

I claim:

1. A device to allow a person to exercise comprising:

(a) a single resisting force means to provide an adjustable amount of continuous force resistance to be lifted from a single point attachment, the force being present during lift and during return, (b) exercise grasping means comprising a horizontal bar to allow the person to grasp the bar and move the bar against the force, (c) cable means comprising two separate cables connecting two separate connection points on the grasping means to the single resisting force means wherein the movement of either connection point lifts against the single resisting force means, (d) a cable directioning means to train the cable means to training point locations positioned in a single plane on both sides of the person enabling the person to move the attachment points on the bar simultaneously against the resisting force means, (e) frame means comprising two vertical frame members the frame members being to support the cable directioning means and the cable means and to resist without distortion the applied forces from the person moving the bar against the single resisting force means, (f) two carriage means, one each freely riding up and down on opposite vertical frame members, and (g) releasable locking means to detachably attach ends of the bar to the two carriage means, wherein the carriage means are isolated from any forces from the single resisting force and any vertical force.

2. The device of claim 1 wherein the single resisting force comprises a stack of weights.

3. The device of claim 1 wherein the cable directioning means trains the cable means to point locations above the person and to point locations proximate to the height of the feet of the person.

4. The device of claim 1 further comprising:

(a) weight distributing means structurally attached to the frame means to receive force from a support platform and transfer the force to the frame means to prevent lifting of the frame, and (b) a support platform located between vertical members of the frame means to hold the person doing the exercises to direct forces downwardly from the person to the weight distribution means.

5. The exercise device of claim 4 wherein the support platform is of a size to allow the person to place his or her body in essentially any position within the frame means to conduct the exercises and wherein the support platform rests on the weight distributing means which comprises a plurality of horizontal floor frame members structurally connected to the bottom end of the vertical members of the frame means.

6. The device of claim 4 further including an exercise bench wherein the weight distributing means comprises a square tubing base frame structurally extending from the bottom ends of the vertical frame members to a bench pivot means which structurally supports and allows the exercise bench to pivot away from the support platform.

7. The device of claim 6 wherein the exercise bench comprises an incline means to allow the bench surface to be supported at various angles together with leg curl means and leg extension means to allow those exercises to be conducted comprising:

(a) a horizontal support member, (b) a horizontal sliding member slidably engaged on the horizontal support member to slide horizontally, (c) a horizontal bench section fixed to the horizontal sliding member having a front edge and a rear edge, (d) an including bench section hingeably connected along the rear edge of the horizontal bench section, the inclining section having a back edge furthest away from the horizontal section, (e) a pair of support frame members hingeably connected to each other end to end, to the back edge and to the horizontal support member, in a configuration such that when the horizontal bench section is slidably moved toward the back edge, the inclining bench section is inclined upwardly, and (f) a locking spring pin means interlocking the position between the horizontal sliding member and the horizontal support member.

8. The device of claim 4 wherein the support platform is a solid wooden floor resting on frame work of the weight distributing means.

9. The device of claim 1 wherein the frame means comprises two vertical frame members, an upper horizontal frame member and a lower horizontal frame member, all structurally and rigidly attached at the corners of the frame.

10. The device of claim 9 wherein the cable distributing means comprises one pulley attached at each corner of the frame to train the cable means to a position above the single resisting force means.

11. The device of claim 9 wherein the vertical frame members have a "C" shaped cross-section with the "C" shape opening to the inside of the frame, and a pair of carriages engaged to ride up and down vertically inside the "C" shape, with each carriage comprising a resting means to provide a support on which the end of the bar rests.

12. The device of claim 11 wherein the resting means comprises a locking means to hold the end of the bar to the resting means.

13. The exercise device of claim 9 wherein the single resisting force means is located outside of the area enclosed by the vertical frame members.

14. The device of claim 9 wherein the cable means comprises two lengths of cable trained vertically upwardly along the vertical frame members toward the upper horizontal frame member to pulleys attached proximate to the inside of the upper frame corners and then trained horizontally to a point directly above the single resisting force means.

15. The device of claim 14 wherein the exercise grasping means comprises a bar with the cable means attached to both ends of the bar, wherein the cable means comprises vertical lengths of cable extending vertically to pulleys attached to the upper support member.

16. The device of claim 14 wherein two cable lengths of the cable means attached to the ends of the bar are trained downwardly to and around pulleys attached in the lower corners of the frame and the two cable lengths are connected to the vertical lengths of cable.

17. The exercise device of claim 1 wherein the carriages are supported at a chosen height using a pin support means comprising:

(a) a plurality of holes at equal heights along the inside of both vertical frames, he holes spaced apart at chosen distance, and (b) a pair of pin supports, one for each frame, each pin support having two pins positioned to engage adjacent holes on the frame, wherein one of the pin supports is angled in an "L" shape to interlock into the hole when both pin supports are engaged in the holes.

18. The device of claim 1 wherein the single resisting force means comprises an adjustable selector length means which allows the positioning of the length of the two separate cables that must be pulled before any resisting force is met.

19. The device of claim 1 which further comprises an adjustable racking means structurally attached to vertical members of the frame means to allow the grasping means comprising a bar to be set into the racking means and supported at any chosen height.

20. The device of claim 19 wherein the single resisting force means further comprises an adjustable selector means to adjust the length of the cables to coincide with a chosen height in the adjustable racking means in which the bar is set where there is no resisting force exerting load against the bar.

21. The device of claim 1 wherein it further comprises:

(a) a seat means to support various portions of the body, (b) a pedestal support means to support the seat means extending vertically between vertical frame members of the frame, structurally detachably attached to the frame, (c) tilt means to allow the seat means to be tilted at chosen angles to the horizontal, (d) a tube member structurally connected to the seat means, and (e) attachment means proximate to the free end of the tube member to detachably attached the tube member to a vertical frame member of the frame means at any chosen height.

22. The device of claim 21 which further comprises a roller means structurally attached to the top of the tube member to allow a person to hook toes or heels under the roller means while doing exercises.

23. The device of claim 1 wherein it further comprises a calf raise exercise means to allow the calf raise exercise to be conducted comprising:

(a) a horizontally positioned "Y" shaped frame member with the opening in the "Y" shape sufficient to rest on the shoulders of a person, (b) pivot attachment means to pivotally attach the base of the "Y" shape to an upright frame member of the frame means, and (c) a cable attachment means located centrally in the "Y" shape to attach the cable means trained downwardly to a pulley attached proximate to the lower inside corner of the frame means closest to the calf raise exercise means, wherein the cable means comprises a cable attached to the cable attachment means, trained downwardly around the pulley, reversing, trained upwardly, and trained over an upper pulley to a position over the single weight means.

24. The device of claim 1 wherein the single resisting force means comprises:

(a) a stack of separate weight members, (b) a cable attachment means to connect to the cable means, (c) a height adjustment means to allow the height of the cable attachment means to be chosen above which any raising of the cable attachment means lifts weight members, and (d) a weight attachment means to allow any chosen number of weight members to be lifted by attachment to the cable attachment means.

25. The device of claim 24 which further comprises hand lifting means to allow hand lifting of the weights lifted by the weight attachment means by a person other than the person doing the exercises.

26. The device of claim 1 wherein the single weight means comprises:

(a) a stack of separate weight members, (b) guide means to allow any or all of the members to be freely upwardly lifted but be restrained from sidewise movement, (c) holes in each weight member vertically aligned to form a single vertical hole through the members, (d) a top member resting on top of the stack of weight members, (e) a cylindrical tubular member structurally and rigidly attached to the top member and slidably interfitting downwardly into the vertical hole through the weight members, (f) an attachment means proximate to the top of the top member to attach to end of the cable means, (g) a vertical rod member structurally attached to the attachment means extending downwardly and slidably interfitting vertically into the cylindrical tubular member, (h) a plurality of horizontal holes spaced along the length of the vertical rod, (i) a plurality of horizontal holes spaced along the length of the cylindrical member, (j) horizontal holes through the weight members wherein chosen holes in the rod, cylindrical member and weight members are all capable of alignment, and (k) pin members to interfit into chosen horizontal holes to interconnect the rod to the top member and a chosen number of weights to the tube.

27. The device of claim 26 wherein a pin member interfits in aligned holes to connect the vertical rod member with the top member to choose the height of lift before any weight members are raised.

28. The device of claim 26 wherein a pin member interconnects a chosen weight member with the cylindrical tubular member to lift all weight members above that chosen weight member.

29. The device of claim 26 wherein the top member is the top weight member.

30. The device of claim 26 wherein two horizontal cantilever hand hold members are structurally attached to the top member extending in opposite directions.

31. The device of claim 1 wherein an "L" seat exercise device is structurally positioned in the frame means comprising:

(a) a pedestal support means to support a seat attached on top, (b) a pivot means to fix seat at any chosen angle to the horizontal, (c) an extension member structurally and rigidly attached to the seat extending parallel to the seat towards a vertical frame member of the frame means, (d) a telescoping means to adjust the length of the extension member, and (e) an attachment means to detachably attach the exposed ends of the extension member to the vertical frame member at an adjustable chosen height.

32. The device of claim 31 further comprising a foot hook means detachably and adjustably attached at varying positions along the top of the extension member to hook the toes of the person exercising on the device.

33. The device of claim 1 wherein movement of the attached bar with respect to the carriage means is restricted horizontally front to back from the plane of the frame, but is essentially unrestricted as to twisting movement and horizontal movement to and from and in the plane of the vertical frame members.

34. The device of claim 1 wherein the carriage means move vertically essentially frictionless.

35. An exercise device comprising:

(a) a support platform to hold and support a person doing exercises, to direct forces downwardly from the person or the auxiliary equipment, (b) a frame comprising two vertical frame members, each having an upper end and a lower end, a lower support member structurally and rigidly connecting the vertical frame members proximate to the lower end, and an upper support member structurally and rigidly connecting the vertical frame members proximate to the upper end, (c) weight distributing means to distribute counter vailing downward force from any exercise being conducted by a person from the support platform to the lower support member, (d) an exercise bar to allow the person using the device to grasp at least one grasping point and move the bar against a weight resistance, wherein the bar has two separated connection points, (e) an adjustable positioning means detachably secured to the vertical frame members to allow the bar to be detachably secured and supported at any chosen height to be trained to only vertical movement, (f) a single weight means to allow an adjustable amount of weight to be lifted from a single point location outside the area enclosed by the vertical frame members, (g) a pulley attached proximate to each inside of the frame, wherein the grasping point and the pulleys at the lower two corners are in a single plane, (h) cable means comprising two separate cables connecting the two connection points trained to the pulleys and finally to the point location on the weight means, wherein movement of either connection point lifts the single weight means, (i) two carriage means, one each freely riding up and down on opposite vertical frame members, and (j) releasable locking means to detachably attach ends of the bar to the two carriage means, wherein the carriage means are isolated from any forces from the single weight means and any vertical force, and (k) an adjustable selector means to allow adjusting the length of the cables to coincide with a chosen height in the adjustable racking means in which the bar is set where all the weights are down and exerting no load against the bar.

36. The device of claim 35 wherein movement of the attached bar with respect to the carriage means is restricted horizontally front to back from the plane of the frame, but is essentially unrestricted as to twisting movement and horizontal movement to and from and in the plane of the vertical frame members.

* * * * *